US010071829B2

(12) United States Patent
Iida

(10) Patent No.: US 10,071,829 B2
(45) Date of Patent: Sep. 11, 2018

(54) SEALED-LETTER PREPARING DEVICE

(71) Applicant: RISO KAGAKU CORPORATION, Tokyo (JP)

(72) Inventor: Kouichiro Iida, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 381 days.

(21) Appl. No.: 14/826,418

(22) Filed: Aug. 14, 2015

(65) Prior Publication Data

US 2016/0059974 A1 Mar. 3, 2016

(30) Foreign Application Priority Data

Aug. 29, 2014 (JP) ..... 2014-175879

(51) Int. Cl.
*B65B 25/14* (2006.01)
*B65B 57/14* (2006.01)
(Continued)

(52) U.S. Cl.
CPC ..... *B65B 25/145* (2013.01); *B65B 57/14* (2013.01); *B65B 63/04* (2013.01); *B65H 29/58* (2013.01);
(Continued)

(58) Field of Classification Search
CPC ..... B65B 25/145; B65H 2801/27; B65H 2801/24–2801/31; B65H 39/02–39/075;
(Continued)

(56) References Cited

U.S. PATENT DOCUMENTS 3,881,718 A * 5/1975 Fernandez-Rana .... B65H 29/00 271/10.09
4,091,596 A * 5/1978 Jones ..... B43M 5/047 493/230
(Continued)

FOREIGN PATENT DOCUMENTS

JP 7-257509 10/1995
JP 10-258805 9/1998
(Continued)

OTHER PUBLICATIONS

Japanese Office Action for JP App. No. 2014-175879 dated May 8, 2018.

*Primary Examiner* — Hemant M Desai
*Assistant Examiner* — Valentin Neacsu
(74) *Attorney, Agent, or Firm* — Greenblum & Bernstein, P.L.C.

(57) ABSTRACT

There are provided: a paper folding unit folding and sending a content sheet to a transfer path; an inserter unit sending an insert sheet to the transfer path; an acquiring unit acquiring information on a top/bottom direction and a surface/obverse direction of the content sheet and insert sheet; a merging unit in which the content sheet folded by the paper folding unit is overlapped with the insert sheet; and an enclosing unit enclosing the merged content sheet and insert sheet into an envelope sheet, in which, when the content sheet and insert sheet merge and are overlapped, the content sheet is folded so that the top/bottom direction and the surface/obverse direction of an image of the content sheet match those of an image of the insert sheet, based on the information acquired by the acquiring unit.

2 Claims, 12 Drawing Sheets

(51) Int. Cl.

| | |
|---|---|
| ***B65B 63/04*** | (2006.01) |
| ***B65H 29/58*** | (2006.01) |
| ***B65H 39/02*** | (2006.01) |
| ***G03G 15/00*** | (2006.01) |
| *B65B 35/10* | (2006.01) |
| *B65B 35/56* | (2006.01) |

(52) U.S. Cl.
CPC ..... *B65H 39/02* (2013.01); *G03G 15/6538* (2013.01); *G03G 15/6594* (2013.01); *B65B 35/10* (2013.01); *B65B 35/56* (2013.01); *B65H 2301/17* (2013.01); *B65H 2301/3331* (2013.01); *B65H 2404/632* (2013.01); *B65H 2701/1916* (2013.01); *B65H 2801/27* (2013.01); *G03G 2215/00514* (2013.01); *G03G 2215/00877* (2013.01)

(58) Field of Classification Search
CPC ..... G03G 2215/00514; G03G 2215/00877; B43M 3/00; B43M 3/02; B43M 3/04
USPC ..... 53/493, 569; 493/917
See application file for complete search history.

(56) References Cited

U.S. PATENT DOCUMENTS 4,318,542 A * 3/1982 Altmann ..... B65H 39/115 271/186
5,183,250 A * 2/1993 Miller ..... B65H 1/04 271/222
5,772,194 A 6/1998 Huebler et al.
2003/0146559 A1* 8/2003 Middelberg ..... B65H 39/06 271/9.01
2004/0144472 A1* 7/2004 Cowie ..... G06K 19/06 156/64
2006/0026927 A1 2/2006 Stemmle
2006/0196374 A1* 9/2006 Stemmle ..... B31B 70/00 101/212
2007/0157578 A1* 7/2007 Fairweather ..... B43M 3/045 53/493
2012/0260606 A1* 10/2012 Noguchi ..... B43M 3/045 53/255
2013/0104498 A1* 5/2013 Naitou ..... B65B 11/48 53/206
2013/0174515 A1* 7/2013 Wakatabi ..... B65H 45/14 53/284.3
2014/0096478 A1* 4/2014 Padros ..... B65B 51/023 53/64
2015/0174848 A1* 6/2015 Padros ..... B43M 5/047 493/239

FOREIGN PATENT DOCUMENTS

| | | |
|---|---|---|
| JP | 2000-295410 | 10/2000 |
| JP | 2002-86987 | 3/2002 |
| JP | 2005-239409 | 9/2005 |
| JP | 2007-320713 | 12/2007 |

* cited by examiner

SEALED-LETTER PREPARING DEVICE

BACKGROUND

1. Technical Field

The present invention relates to a sealed-letter preparing device that arranges a printed medium transferred from an image forming device and a printed medium set on an inserter so as to match the top/bottom directions and the surface/obverse directions thereof in accordance with the orientation of the printed sheet that has been set and folded on the inserter, and encloses them in an envelope.

2. Related Art

Conventionally, an image forming device has been known, which includes an enclosing and sealing device that folds a printed medium on which printing is performed with the image forming device, and encloses the printed medium into an envelope. However, there is an increasing need for the image forming device including the enclosing and sealing device, to enclose in an envelope a printed medium printed and folded outside or an inserter printed medium such as a booklet having plural printed media bound therein by overlapping it with a printed medium printed with the image forming device. For example, a system having an inserter provided on the downstream side of the image forming device to insert the inserter printed medium is put into practical use (for example, Patent Literature 1).

The technique disclosed in Patent Literature 1 relates to an image forming system that includes an image forming device having an inserter. This image forming system performs printing processing after image data are rotated in order to match the orientation of an image on a sheet loaded on a tray of the inserter with the orientation of an image inputted with an image reading unit.

Here, in the case where the printed sheet fed from the inserter and the printed sheet transferred from the image forming device are overlapped with each other and are enclosed in the envelope, it is necessary to arrange the folded printed sheets so as to match the top/bottom directions and the surface/obverse directions thereof. This is consideration for a recipient of the sealed letter to facilitate reading of a content when the envelope is opened and the content is unfolded, and is prerequisite for a sealed letter sent to customers such as a direct mail and an invoice.

Patent Document 1: Japanese Patent Application Laid-Open Publication No. 2000-295410

SUMMARY

However, with the technique disclosed in Patent Literature 1, consideration is not given to the top/bottom direction and the surface/obverse direction of an image at the time of folding the printed media having the image formed thereon. Thus, it is not possible to match the top/bottom directions and the surface/obverse directions of the image on the folded printed sheet and the image on the inserter printed medium. The present invention has been made in view of the problem described above, and an object of the present invention is to provide a sealed-letter preparing device that can arrange an image on a printed medium set on an inserter and an image on a printed medium transferred from an image forming device and then folded, so as to match the top/bottom directions and the surface/obverse directions thereof, and enclose them in an envelope.

In order to achieve the object described above, a first characteristic of a sealed-letter preparing device according to the present invention provides a sealed-letter preparing device that encloses a first content and a second content into an envelope sheet transferred on a transfer path, the sealed-letter preparing device comprising:

a paper folding unit that folds the first content, and sends the first content to the transfer path;

an inserter unit that sends the second content to the transfer path;

an acquiring unit that acquires information on a top/bottom direction and a surface/obverse direction of the first content and the second content, each of which is sent by the inserter unit;

a paper-folding controller that changes a way of folding performed by the paper folding unit according to the information acquired by the acquiring unit;

a merging unit in which the first content folded by the paper folding unit is overlapped with the second content sent by the inserter unit; and an enclosing unit that encloses the first content and the second content, which merge in the merging unit, into the envelope sheet, wherein when the first content and the second content merge and are overlapped in the merging unit, the paper-folding controller controls the paper folding unit so that the top/bottom direction and the surface/obverse direction of an image of the first content match the top/bottom direction and the surface/obverse direction of an image of the second content, based on the information acquired by the acquiring unit.

A second characteristic of a sealed-letter preparing device according to the present invention further includes a path switching unit that switches a transfer path for performing transfer to the merging unit, so as to adjust a vertical relationship (positional relationship in a height direction) of the first content and the second content sent by the inserter unit when these contents merge and are overlapped in the merging unit.

DETAILED DESCRIPTION

Hereinbelow, an enclosing and sealing system 1 including a sealed-letter preparing device 5 according to an embodiment of the present invention will be described. In the following description, sheets may have any size. Furthermore, in the following embodiment, printing is performed, for example, by ink jet printing. However, printing may be performed through any other methods, and printing forms are not particularly limited in the present invention.

<Configuration of Enclosing and Sealing System>

Described below is a configuration of the enclosing and sealing system 1 according to an embodiment of the present invention. Note that, in the description below, the term "upstream" represents upstream when viewed from a direction in which a content sheet and the like are transferred, and the term "downstream" represents downstream when viewed from a direction in which a content sheet and the like are transferred. Furthermore, in FIG. 1, "L" indicates a left direction when viewed from the front, and "R" indicates a right direction when viewed from the front.

Figure 1:
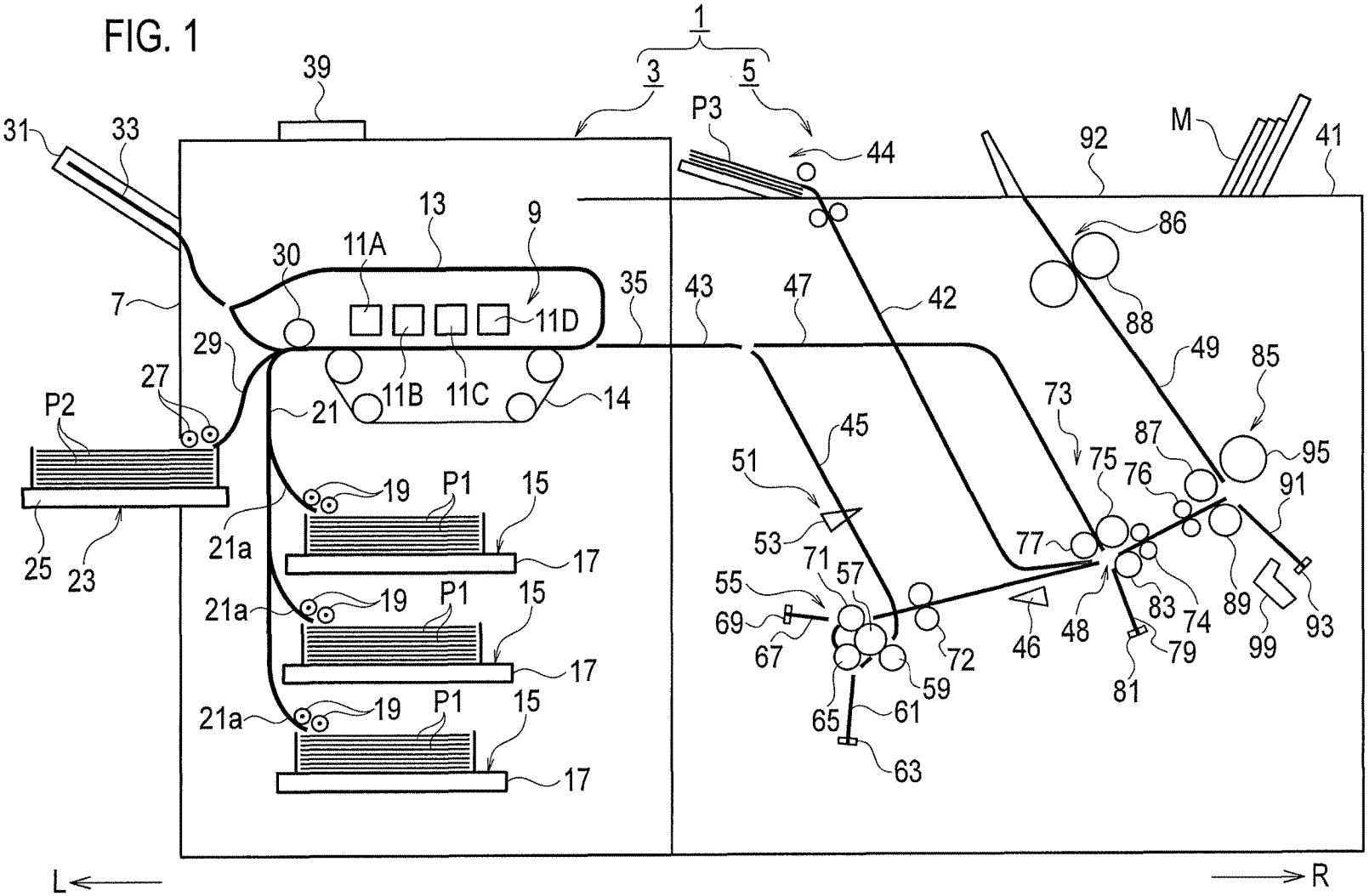
FIG. 1 is an elevation view schematically illustrating an enclosing and sealing system including an enclosing and sealing device according to a first embodiment of the present invention.
Figure 2:
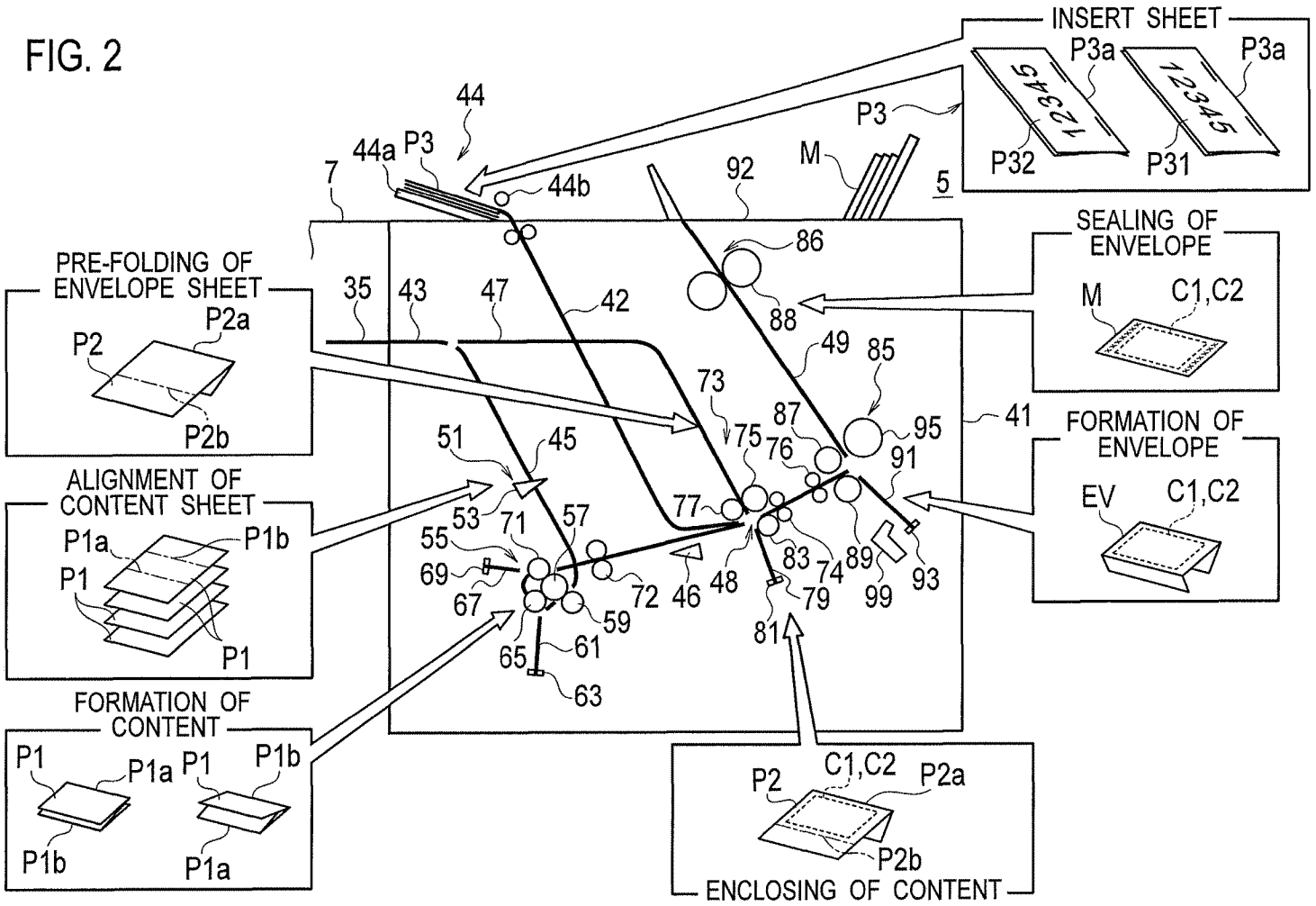
FIG. 2 is a configuration diagram illustrating a configuration of the enclosing and sealing device according to the first embodiment of the present invention.

FIG. 1 is an elevation view schematically illustrating the enclosing and sealing system 1 including the sealed-letter preparing device 5 according to one embodiment of the present invention. FIG. 2 is a configuration diagram illustrating a configuration of the sealed-letter preparing device according to the first embodiment.

As illustrated in FIG. 1 and FIG. 2, this enclosing and sealing system 1 includes: an image forming device 3 that performs printing on plural content sheets P1 (first contents) and an envelope sheet P2; and a sealed-letter preparing device 5 provided at a position adjacent to this image forming device 3. Here, the image forming device 3 performs printing on the plural content sheets P1 and the envelope sheet P2. The sealed-letter preparing device 5 forms a content C1 and an envelope EV from the plural content sheets P1 and the envelope sheet P2, respectively, on which printing has been already performed; transfers a content C2, which is made from an insert sheet P3 (second content) on which printing has been already performed through printing processing outside; and seals the envelope EV in a state where the contents C1 and C2 are enclosed in the envelope EV, thereby creating a sealed letter M.

<Configuration of Image Forming Device>

As illustrated in FIG. 1, the image forming device 3 includes an image forming device housing (hereinafter, referred to as a device housing 7 as appropriated). In the device housing 7, a printing unit 9 is provided that performs ink-jet printing on the content sheets P1 and the envelope sheet P2, based on image data (content image data and envelope image data) contained in each job. This printing unit 9 includes plural line-type ink heads 11A, 11B, 11C, and 11D that eject inks of black, cyan, magenta, and yellow.

An annular platen belt 14 is provided immediately below the ink heads 11A, 11B, 11C, and 11D. The content sheet P1 and the envelope sheet P2 are sucked on the platen belt 14 with a suction fan (not illustrated) provided within the platen belt 14, and content image data and envelope image data are printed on the content sheet P1 and the envelope sheet P2, respectively, with inks ejected from the ink heads 11A, 11B, 11C, and 11D, while these sheets are being transferred on a transfer path at a predetermined transfer speed.

The distances between the platen belt 14 and the ink heads 11A, 11B, 11C, and 11D are set to be narrow in order to cause the inks to land at appropriate positions. Thus, it is necessary to reduce deformation of the envelope sheet P2 as much as possible to prevent the envelope sheet P2 transferred by the platen belt 14 from being brought into contact with the ink heads 11A, 11B, 11C, and 11D.

Furthermore, a loop-shaped printing transfer path 13 for transferring the content sheet P1 and the envelope sheet P2 is provided within the device housing 7 so as to surround the printing unit 9. Plural pairs of first transferring rollers (not illustrated) that hold and transfer the content sheet P1 and the envelope sheet P2 are disposed at intervals along the printing transfer path 13 within the device housing 7. The plural pairs of first transferring rollers can rotate with drive of an appropriate first transferring motor (not illustrated).

Plural content sheet feeding units 15 that sequentially feed the plural content sheets P1 toward the printing unit 9 side (printing transfer path 13 side) are provided in layers in the vertical direction (in the height direction) below the printing unit 9 within the device housing 7. Each of the content sheet feeding units 15 includes a paper feed tray 17 that loads plural content sheets P1, and plural paper feeding rollers 19 that sequentially send the plural content sheets P1 loaded on this paper feed tray 17 toward the printing unit 9 side. The plural paper feeding rollers 19 can rotate with drive of an appropriate content sheet feeding motor (not illustrated).

Furthermore, a fed-paper transfer path 21 for transferring the content sheet P1 toward the printing unit 9 side is provided on the left part within the device housing 7. This fed-paper transfer path 21 includes two branch portions 21*a* on the upstream end side (proximal end side). Furthermore, the end portion of each of the branch portions 21*a* of the fed-paper transfer path 21 is connected with a corresponding content sheet feeding unit 15, and the downstream end portion (distal end portion) of the fed-paper transfer path 21 is connected with the printing transfer path 13. Furthermore, plural pairs of second transferring rollers (not illustrated) that hold and transfer the content sheet P1 are disposed at intervals along the fed-paper transfer path 21 within the device housing 7. The plural pairs of second transferring rollers can rotate with drive of an appropriate second transferring motor (not illustrated).

An envelope sheet feeding unit 23 that feeds the envelope sheet P2 toward the printing unit 9 side (printing transfer path 13 side) is provided on the left side portion of the device housing 7. This envelope sheet feeding unit 23 includes a paper feed tray 25 that loads plural envelope sheets P2, and plural paper feeding rollers 27 that send the envelope sheet P2 loaded on this paper feed tray 25 toward the printing unit 9 side. Plural paper feeding rollers 27 can rotate with drive of an appropriate envelope sheet feeding motor (not illustrated). Furthermore, a fed-paper transfer path 29 for transferring the envelope sheet P2 toward the printing unit 9 side is provided on the left part within the device housing 7. The upstream end portion (proximal end portion) of this fed-paper transfer path 29 is connected with the envelope sheet feeding unit 23, and the downstream end portion (distal end portion) of the fed-paper transfer path 29 is connected with the printing transfer path 13. In addition, plural pairs of third transferring rollers (not illustrated) that hold and transfer the envelope sheet P2 are disposed at intervals along the fed-paper transfer path 29 within the device housing 7. The plural pairs of third transferring rollers can rotate with drive of an appropriate third transferring motor (not illustrated). Note that the content sheet P1 may be placed on the paper feed tray 25, and the envelope sheet P2 may be placed on the paper feed tray 17.

The envelope sheet P2 transferred on the fed-paper transfer path 29 and the content sheet P1 transferred on the fed-paper transfer path 21 are hit against a registration roller 30. This causes occurrence of slack in the envelope sheet P2 and the content sheet P1. With this slack, the leading edge of each of the envelope sheet P2 and the content sheet P1 is aligned, and skew thereof is corrected. Then, these sheets are transferred toward the printing unit 9 at predetermined timing.

A cassette 31 that temporarily stores the content sheet P1 and the envelope sheet P2 is provided in the upper of the left side of the printing transfer path 13. Furthermore, a switchback transfer path 33 for inverting the content sheet P1 and the envelope sheet P2 in terms of the surface/obverse direction and transferring them toward the printing unit 9 side is provided from the left portion within the device housing 7 to the inside of the cassette 31. The proximal end portion of this switchback transfer path 33 is configured so as to be able to be connected or disconnected with the printing transfer path 13 through operations of a known flapper for switchback (not illustrated). Furthermore, an input-output roller pair (not illustrated) that holds and pulls the content sheet P1 and the envelope sheet P2 toward the switchback transfer path 33 side or that holds and sends the content sheet P1 and the envelope sheet P2 from the switchback transfer path 33 side is provided on the left part within the device housing 7. The input-output roller pair can rotate in forward and reverse directions with drive of an appropriate input-output transferring motor (not illustrated).

A communicating transfer path 35 for transferring the content sheet P1 and the envelope sheet P2, which are sent from the printing transfer path 13, toward the sealed-letter preparing device 5 side (toward the right direction) is provided on the right part within the device housing 7. The upstream end portion (proximal end portion) of this communicating transfer path 35 is configured so as to be able to be connected or disconnected with the printing transfer path 13 through operations of a known flapper for communication (not illustrated). Furthermore, plural pairs of fourth transferring rollers (not illustrated) that hold and transfer the content sheet P1 and the envelope sheet P2 are disposed at intervals along the communicating transfer path 35 within the device housing 7. The plural pairs of fourth transferring rollers can rotate with drive of an appropriate fourth transferring motor (not illustrated).

<Configuration of Sealed-Letter Preparing Device>

Figure 3A:
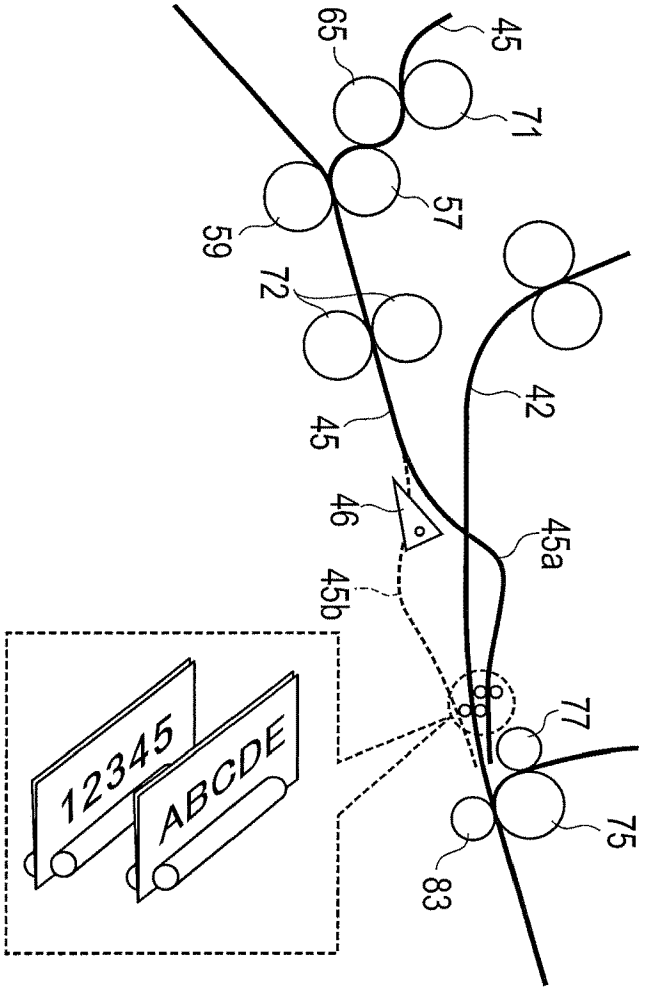
FIG. 3A is an enlarged view illustrating a content sheet transfer path containing a switching unit according to the first embodiment of the present invention in the case where the switching unit selects an upper transfer path.
Figure 3B:
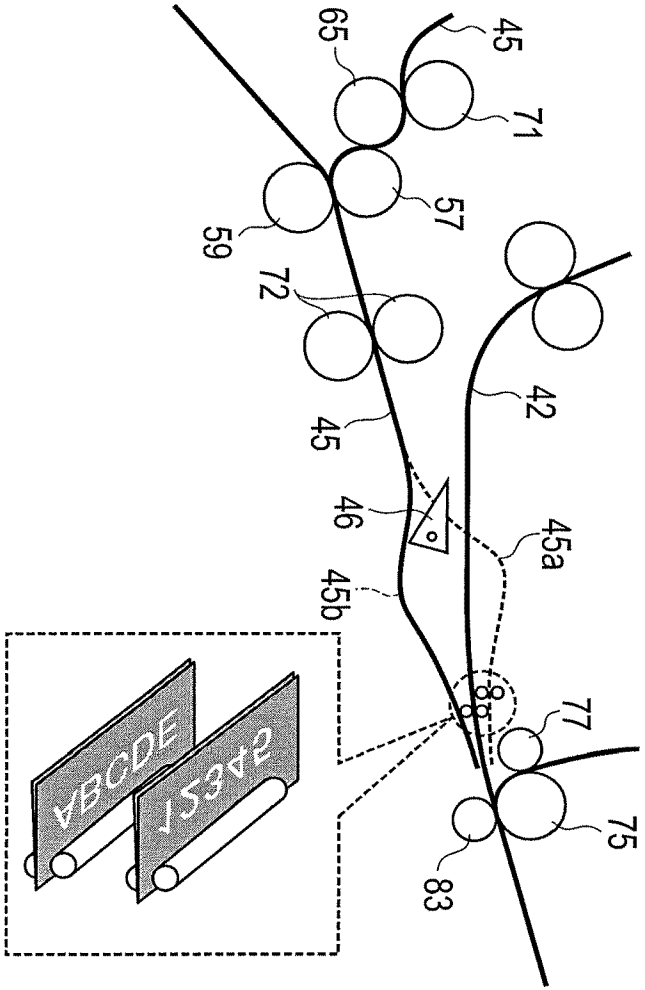
FIG. 3B is an enlarged view illustrating the content sheet transfer path containing the switching unit according to the first embodiment of the present invention in the case where the switching unit selects a lower transfer path.
Figure 4A:
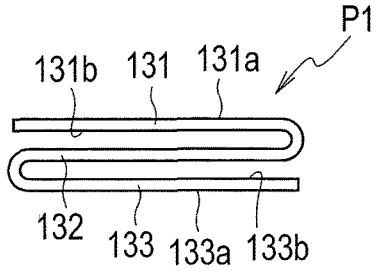
FIG. 4A is an explanatory diagram illustrating, from a side surface, a content sheet according to the first embodiment of the present invention in a state of being outwardly folded in three.
Figure 4B:
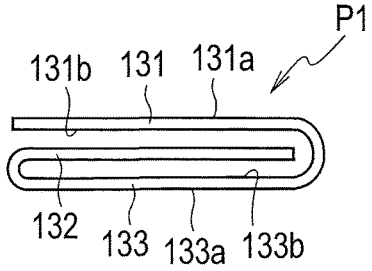
FIG. 4B is an explanatory diagram illustrating, from a side surface, a content sheet according to the first embodiment of the present invention in a state of being inwardly folded in three.

Next, the configuration of the sealed-letter preparing device will be described. FIGS. 3A and 3B are enlarged views each illustrating a content sheet transfer path containing a switching unit according to the first embodiment. FIG. 3A illustrates a case where the switching unit selects an upper transfer path. FIG. 3B illustrates a case where the switching unit selects a lower transfer path. FIGS. 4A and 4B are explanatory diagrams each illustrating, from a side surface, a content sheet folded in three according to the first embodiment. FIG. 4A illustrates a content sheet in a state of being outwardly folded in three. FIG. 4B illustrates a content sheet in a state of being inwardly folded in three.

As illustrated in FIG. 1 and FIG. 2, the sealed-letter preparing device 5 is a device that encloses the content sheet P1 and the insert sheet P3 into the envelope sheet P2 transferred on the transfer path. The sealed-letter preparing device 5 includes a sealed-letter preparing device housing (hereinafter, referred to as a device housing 41 as appropriate). A lead-in transfer path 43 for transferring, toward the right direction, the content sheet P1 and the envelope sheet P2, which have been sent from the communicating transfer path 35 of the image forming device 3 and on which printing has been already performed, is provided within this device housing 41. The upstream end portion (proximal end portion) of this lead-in transfer path 43 is connected with the downstream end portion (distal end portion) of the communicating transfer path 35. Plural pairs of fifth transferring rollers (not illustrated) that hold and transfer the content sheet P1 and the envelope sheet P2, on which printing has been already performed, are disposed at intervals along the lead-in transfer path 43 within the device housing 41. The plural pairs of fifth transferring rollers can rotate with drive of an appropriate fifth transferring motor (not illustrated).

A content sheet transfer path 45 for transferring, for example, the content sheet P1 (including the content C1), on which printing has been already performed, is provided within the device housing 41. The upstream end portion (proximal end portion) of this content sheet transfer path 45 is configured so as to be able to be connected or disconnected with the downstream end portion (distal end portion) of the lead-in transfer path 43 through operations of a known flapper for enclosing and sealing. Furthermore, plural pairs of sixth transferring rollers (not illustrated) that hold and transfer, for example, the content sheet P1, on which printing has been already performed, are disposed at intervals along the content sheet transfer path 45 within the device housing 41. The plural pairs of sixth transferring rollers can rotate with drive of an appropriate sixth transferring motor (not illustrated).

An envelope sheet transfer path 47 for transferring the envelope sheet P2, on which printing has been already performed, is provided above the content sheet transfer path 45 within the device housing 41. The upstream end portion (proximal end portion) of this envelope sheet transfer path 47 is configured so as to be able to be connected or disconnected with the downstream end portion of the lead-in transfer path 43 through operations of the known flapper for enclosing and sealing described above. Furthermore, plural pairs of seventh transferring rollers (not illustrated) that hold and transfer the envelope sheet P2, on which printing has been already performed, are disposed at intervals along the envelope sheet transfer path 47 within the device housing 41. The plural pairs of seventh transferring rollers can rotate with drive of an appropriate seventh transferring motor (not illustrated). The downstream end side of the content sheet transfer path 45 merges with the downstream end side of the envelope sheet transfer path 47 in a merging unit 48.

Furthermore, an inserter unit 44 is provided within the device housing 41. The inserter unit 44 is a transferring unit that sends the insert sheet P3 toward the transfer path of the envelope sheet P2 in an interlocked manner with folding operations in a paper folding unit 55. As illustrated in FIG. 2, this inserter unit 44 includes a paper feed tray 44*a* that loads the insert sheet P3, and plural paper feeding rollers 44*b* that send the insert sheet P3 loaded on the paper feed tray 44*a* toward the inside of the device housing 41. The plural paper feeding rollers 44*b* can rotate with drive of an appropriate paper feeding motor (not illustrated).

Here, in this embodiment, the insert sheet P3 to be inserted has a booklet shape having plural printed sheets bound therein with staples. As illustrated in FIG. 2, the stapled end of the insert sheet P3 described above is referred to as a bound end P3*a*.

In this embodiment, the insert sheet P3 includes an insert sheet P31 having an image formed thereon with the bound end P3*a* side being set as a "top side" in the top/bottom direction, and an insert sheet P32 having an image formed thereon with the bound end P3*a* side being set as a "bottom side" in the top/bottom direction.

It should be noted that the top/bottom direction means top or bottom of print contents printed on the printed sheet. In other words, the top/bottom direction means a direction (forward direction or inverted direction) of print contents with respect to a sheet feeding direction (transfer direction). In this embodiment, the state of the insert sheet P31 is referred to as a "top direction state" whereas the state of the insert sheet P32 is referred to as a "bottom direction state."

For example, in the case where an image formed on the insert sheet P3 is a character original as illustrated in FIG. 2, the upper end of each of characters constituting the character original formed on the insert sheet P31 is located closer to the bound end P3*a* side than the lower end of each of the characters. As described above, the insert sheet P31 has an image formed thereon with the bound end P3*a* side being set as the "top side" in the top/bottom direction, and the state of the insert sheet P3 as described above is referred to as a "top direction state."

Furthermore, the lower end of each of characters constituting a character original formed on the insert sheet P32 is located closer to the bound end P3*a* side than the upper end of each of the characters. As described above, the insert sheet P32 has an image formed thereon with the bound end P3*a* side being set as the "bottom side" in the top/bottom direction, and the state of the insert sheet P3 as described above is referred to as a "bottom direction state."

In this embodiment, the top/bottom direction of the insert sheet P3 is defined on the basis of an image formed on the front cover side of the insert sheet P3 of images formed on the insert sheet P3. The reason for this is that, when a person who receives a sealed letter M opens this sealed letter M, and holds contents C1, C2 on its hand, the image on the front cover side of the contents C1, C2 is more likely to attract its attention.

As described above, when comparison is made between the insert sheet P31 and the insert sheet P32, bound ends P3*a*, which are the stapled sides, are located at positions exactly opposite to each other with respect to the image formed thereon. In other words, when comparison is made between the "top direction state" and the "bottom direction state," the images formed on the insert sheet P3 face opposite directions to each other when the bound end P3*a* is used as a reference, and the top/bottom direction is inverted.

Furthermore, such an insert sheet P3 (insert sheets P31 and P32) is assumed to be set manually on the paper feed tray 44*a* by a user so that the bound end P3*a* is located on the downstream side in the transfer direction.

In this embodiment, it is assumed that the "surface direction state" represents a state of the sheet set so that the front cover side of the insert sheet P3 serves as the upper surface, and the "obverse direction state" represents a state of the sheet set so that the front cover side of the insert sheet P3 serves as the lower surface. In comparison between the "surface direction state" and the "obverse direction state," the surface/obverse direction of the insert sheet P3 is inverted. When the user manually sets the insert sheet P3 on the paper feed tray 44*a*, the insert sheet P3 can be set in two ways: the "surface direction state" and the "obverse direction state."

It should be noted that, in this embodiment, the printed sheet to be inserted into the inserter is a booklet having a bound end. However, the present invention is not limited to this, and for example, it may be possible to employ a printed sheet that is folded. In this case too, the printed sheet is set on the paper feed tray 44*a* by the user so that the bound end (in other words, back side) is located on the downstream side. A sheet sensor (not illustrated) is provided to the paper feed tray 44*a*, and it is possible to detect that a sheet is set on the paper feed tray 44*a*.

The inserter unit 44 is provided with an insert sheet transfer path 42 for merging the insert sheet P3, which is sent to the inside of the device housing 41 by the paper feeding roller 44*b*, into the device housing 41. Plural pairs of eighth transferring rollers (not illustrated) that hold and transfer the insert sheet P3 are disposed at intervals along the insert sheet transfer path 42 of the device housing 41. The plural pairs of eighth transferring rollers can rotate with drive of an appropriate eighth transferring motor (not illustrated). The downstream end portion of this insert sheet transfer path 42 is configured so as to be able to be connected or disconnected with the merging unit 48 through operations of a known flapper for enclosing and sealing.

An envelope transfer path 49 for transferring, for example, an envelope EV (including the sealed letter M) in a state of containing the content C1 is provided on the downstream side (exit side) after the content sheet transfer path 45, the insert sheet transfer path 42, and the envelope sheet transfer path 47 merge in the merging unit 48. Furthermore, this envelope transfer path 49 extends so as to reach the upper part of the device housing 41. Furthermore, plural pairs of ninth transferring rollers (not illustrated) that hold and transfer, for example, the envelope EV are disposed at intervals along the envelope transfer path 49 within the device housing 41. The plural pairs of ninth transferring rollers can rotate with drive of an appropriate ninth transferring motor (not illustrated).

An aligning unit 51 is provided at some midpoint in the content sheet transfer path 45. This aligning unit 51 collects and aligns the printed plural content sheets P1, which are sent from the lead-in transfer path 43. The aligning unit 51 includes an alignment gate 53 (stand-by gate) that keeps the printed plural content sheets P1 on stand-by. This alignment gate 53 is designed so as to be able to switch the content sheet transfer path 45 between an open state and a closed state.

A paper folding unit 55 is provided on the exit side (downstream side) of the aligning unit 51 in the content sheet transfer path 45. The paper folding unit 55 is a unit that folds the content sheet P1 into at least three or more portions including the upper portion, the middle portion, and the lower portion, and sends it toward the content sheet transfer path 45. The paper folding unit 55 folds the plural content sheets P1, which are sent from the aligning unit 51 and have been aligned, to form the content C1.

The specific configuration of the paper folding unit 55 will be described below. A main folding roller 57 is rotatably provided on the exit side (downstream side) of the aligning unit 51 within the device housing 41. A lead-in roller 59 is rotatably provided at a position adjacent to the main folding roller 57 within the device housing 41, and guides the content sheet P1 from the content sheet transfer path 45 in cooperation with the main folding roller 57. In addition, a guide plate 61 is provided below the main folding roller 57 within the device housing 41, and guides the content sheet P1 guided by the main folding roller 57 and the lead-in roller 59. The guide plate 61 is provided with a jogging member 63 against which (the leading edge of) the content sheet P1 hits to give a slack in the vicinity of the folding line P1*a* of the content sheet P1. This jogging member 63 can be positionally adjusted along the guide plate 61 with drive of an appropriate first position-adjusting motor (not illustrated). In addition, an intermediate roller 65 is rotatably provided at a position adjacent to the main folding roller 57 within the device housing 41 and facing the lead-in roller 59. In a state where the vicinity of the folding line P1*a* of the content sheet P1 is made slackened, this intermediate roller 65 folds the content sheet P1 from the folding line P1*a* in cooperation with the main folding roller 57.

A guide plate 67 that guides the content sheet P1 folded with the main folding roller 57 and the intermediate roller 65 is provided on the left of the main folding roller 57 within the device housing 41. The guide plate 67 is provided with a jogging member 69 that is hit against (the leading edge of) the content sheet P1 to give a slack in the vicinity of the folding line P1*b* of the content sheet P1. This jogging member 69 can be positionally adjusted along the guide plate 67 with drive of an appropriate second position-adjusting motor (not illustrated). In addition, a lead-out roller 71 is rotatably provided at a position adjacent to the main folding roller 57 within the device housing 41 and facing the intermediate roller 65. In a state where the vicinity of the folding line P1*b* of the content sheet P1 is made slackened, this lead-out roller 71 folds the content sheet P1 from the folding line P1*b* in cooperation with the main folding roller 57, and at the same time, guides the content sheet P1 toward the content sheet transfer path 45 side.

Here, the main folding roller 57, the lead-in roller 59, the intermediate roller 65, and the lead-out roller 71 can rotate with drive of an appropriate first folding motor (not illustrated). Furthermore, in this embodiment, the content sheet P1 is folded outward or inward with drive of each of the rollers as appropriate.

In the case where the content sheet is "folded outward" so as to be folded in three portions, this folding is so-called "outer threefold", and the content is folded into a z shape. More specifically, the term "outer threefold" as used herein means that the print sheet is divided into three areas; mountain fold is made on one area of the three areas; and valley fold is made on the other area, whereby the print sheet is folded into a shape of the letter z. In this embodiment, valley fold is made on the folding line P1*b* located on the downstream side in the transfer direction, and mountain fold is made on the folding line P1*a* located on the upstream side in the transfer direction. In this case, the upper portion and the lower portion have the same top/bottom direction on the same paper sheet of the content sheet P1.

On the other hand, in the case where the content sheet is "folded inward" so as to be folded in three portions, this folding is so-called "inner threefold", and the content is folded such that the lower portion is located behind the upper portion. More specifically, the term "inner threefold" as used herein means that the print sheet is divided into three areas, and is folded in a manner that two areas located on both ends of the three areas overlap with each other so as to face inwardly toward the center portion. In this embodiment, as illustrated in FIG. 2, folding is performed on the folding line P1*a* located on the upstream side in the transfer direction, and then, folding is performed on the folding line P1*b* located on the downstream side in the transfer direction. In this case, the upper portion and the lower portion have the inverted top/bottom direction on the same paper sheet of the content sheet P1.

In the case where the content sheet P1 is folded in outer threefold or inner threefold as described above, the content sheet P1 is in a state where three sheet members overlap with each other as illustrated in FIGS. 4A and 4B. In this case, a sheet located on the upper portion with the transfer path serving as the bottom surface is referred to as an upper-portion sheet 131, a sheet located on the lower portion is referred to as a lower-portion sheet 133, and a sheet located on the middle portion is referred to as a middle-portion sheet 132. Furthermore, a face located on the outside of the upper-portion sheet 131 is referred to as an external surface 131*a*, and a face located on the inside thereof is referred to as an inner surface 131*b*. In addition, a face located on the outside of the lower-portion sheet 133 is referred to as an external surface 133*a*, and a face located on the inside thereof is referred to as an inner surface 133*b*.

It should be noted that it may be possible to employ a configuration in which the paper folding unit 55 folds into at least three portions including the upper portion, the middle portion, and the lower portion to make three folds such as inner threefold and outer threefold (z-shaped folding) described above, or make simple twofold, four folds such as inner fourfold (double gate fold), or other various ways of folding with various numbers of times of folding. In the case where the number of portions is three or more, for example, in the case of four portions, the first portion on the top portion serves as the upper portion, the fourth portion on the bottom portion serves as the lower portion, and the other second and third portions serve as the middle portions.

Two paths (an upper transfer path 45*a* and a lower transfer path 45*b*) that merge with the insert sheet transfer path 42 are provided on the exit side (downstream side) of the paper folding unit 55 on the content sheet transfer path 45.

FIGS. 3A and 3B are enlarged views concerning a portion between a paper folding unit and an enclosing unit and illustrating a path switching unit 46 on the content sheet transfer path 45 of the sealed-letter preparing device 5. In particular, FIG. 3A illustrates a case where the path switching unit 46 selects an upper transfer path, and FIG. 3B illustrates a case where the path switching unit 46 selects a lower transfer path.

One of the two paths merging with the insert sheet transfer path 42 is an upper transfer path 45*a* located upper than the insert sheet transfer path 42. The upper transfer path 45*a* causes the content sheet P1 to be located upper than the insert sheet P3, and then flow into the merging unit 48. The other path is a lower transfer path 45*b* located lower than the insert sheet transfer path 42. The lower transfer path 45*b* causes the content sheet P1 to be located lower than the insert sheet P3, and then flow into the merging unit 48. Furthermore, the path switching unit 46 that switches a transfer destination of the content sheet P1 folded in the paper folding unit 55 between the upper transfer path 45*a* and the lower transfer path 45*b* is provided on the content sheet transfer path 45.

The path switching unit 46 is one that switches the up-down positional relationship of the content sheet P1 and the insert sheet P3 to be sent to a transfer path on the enclosing unit 73 side. More specifically, as illustrated in FIG. 3A, the path switching unit 46 switches a transfer destination of the content sheet P1 so as to be the upper transfer path 45*a*, thereby overlapping the folded content sheet P1 on the upper part of the insert sheet P3. Furthermore, the path switching unit 46 switches a transfer destination of the content sheet P1 to be the lower transfer path 45*b*, thereby overlapping the folded content sheet P1 on the lower part of the insert sheet P3. Note that this path switching unit 46 makes switch on the basis of placement information on the insert sheet P3 inserted with the inserter unit 44. Details of the placement information will be described later.

An enclosing unit 73 is provided adjacent the merging unit 48 in which the upper transfer path 45*a* and the lower transfer path 45*b* merge with the envelope sheet transfer path 47. This enclosing unit 73 encloses the content sheet P1 folded by the paper folding unit 55 and the insert sheet P3 inserted with the inserter unit 44 into the envelope sheet P2. More specifically, the paper folding unit 55 pre-folds the content sheet P1 that is sent from the communicating transfer path 35, and the enclosing unit 73 encloses the contents C1, C2 transferred from the respective transfer paths in the envelope sheet P2.

Described below is a specific configuration of the enclosing unit 73. A main folding roller 75 is rotatably provided in the enclosing unit 73. A lead-in roller 77 is rotatably provided at a position adjacent to the main folding roller 75 within the device housing 41, and guides the envelope sheet P2 from the envelope sheet transfer path 47 in cooperation with the main folding roller 75. Furthermore, a guide plate 79 is provided below the main folding roller 75 within the device housing 41, and guides the envelope sheet P2 led in with the main folding roller 75 and the lead-in roller 77. The guide plate 79 is provided with a jogging member 81 against which (the leading edge of) the envelope sheet P2 hits to give a slack in the vicinity of the folding line P2*a* of the envelope sheet P2. This jogging member 81 can be positionally adjusted along the guide plate 79 with drive of an appropriate third position-adjusting motor (not illustrated). Furthermore, a lead-out roller 83 is rotatably provided at a position adjacent to the main folding roller 75 within the device housing 41 and facing the lead-in roller 77. This lead-out roller 83 folds the envelope sheet P2 from the folding line P2*a* in cooperation with the main folding roller 75 in a state where the vicinity of the folding line P2*a* of the envelope sheet P2 is made slackened. Then, the lead-out roller 83 sends the envelope sheet P2 toward the envelope forming unit 85 while enclosing the contents C1, C2 transferred with the transferring roller 72 into the envelope sheet P2. Here, the main folding roller 75, the lead-in roller 77, and the lead-out roller 83 can rotate with drives of appropriate second folding motors (not illustrated).

Transferring rollers 74 and 76 that send the envelope sheet P2 having the contents C1, C2 enclosed therein toward the envelope forming unit 85 side are provided on the downstream side of the enclosing unit 73. Furthermore, an envelope forming unit 85 is provided on the downstream side of the enclosing unit 73. This envelope forming unit 85 folds the envelope sheet P2 sent from the enclosing unit 73 to form an envelope EV.

Described below is a specific configuration of the envelope forming unit 85. A main folding roller 87 is rotatably provided on the exit side (downstream side) of the enclosing unit 73 within the device housing 41. A lead-in roller 89 that leads in the envelope sheet P2 from the envelope sheet transfer path 47 in cooperation with the main folding roller 87 is rotatably provided at a position adjacent to the main folding roller 87 within the device housing 41. Furthermore, a guide plate 91 is provided below the main folding roller 87 within the device housing 41, and guides the envelope sheet P2 led in with the main folding roller 87 and the lead-in roller 89. The guide plate 91 is provided with a jogging sheet metal 93 against which (the leading edge of) the envelope sheet P2 hits to give a slack in the vicinity of the folding line P2*b* of the envelope sheet P2. This jogging sheet metal 93 can be positionally adjusted along the guide plate 91. Furthermore, a watering mechanism unit 99 that applies water to a remoistenable-adhesive portion having remoistenable adhesive such as water-based adhesive applied thereto of an envelope sheet P2, which will be described later, is provided along the guide plate 91 and in the vicinity of the jogging sheet metal 93.

Furthermore, a final folding roller 95 is rotatably provided at a position adjacent to the main folding roller 87 within the device housing 41 and facing the lead-in roller 89. This final folding roller 95 folds the envelope sheet P2 from the folding line P2*b* in cooperation with the main folding roller 87 in a state where the vicinity of the folding line P2*b* of the envelope sheet P2 is made slackened.

Furthermore, as illustrated in FIG. 1 and FIG. 2, a sealing unit 86 is provided at some midpoint in the envelope transfer path 49. This sealing unit 86 seals the envelope EV sent from the envelope forming unit 85. Furthermore, the sealing unit 86 includes a sealing roller pair 88 that holds and presses the envelope EV. This sealing roller pair 88 can rotate with drive of an appropriate sealing motor (not illustrated). Here, the envelope EV is designed so as to be sealed by being held and pressed by the sealing roller pair 88 due to an adhesive effect of pressure-sensitive adhesive agent applied in advance to the envelope sheet P2. Furthermore, a sealed-letter discharging unit 92 that discharges a sealed letter M, which is correctly sealed and is sent from the envelope transfer path 49, is provided on the downstream side of the envelope transfer path 49.

(Functional Configuration of Enclosing and Sealing System)

Figure 5:
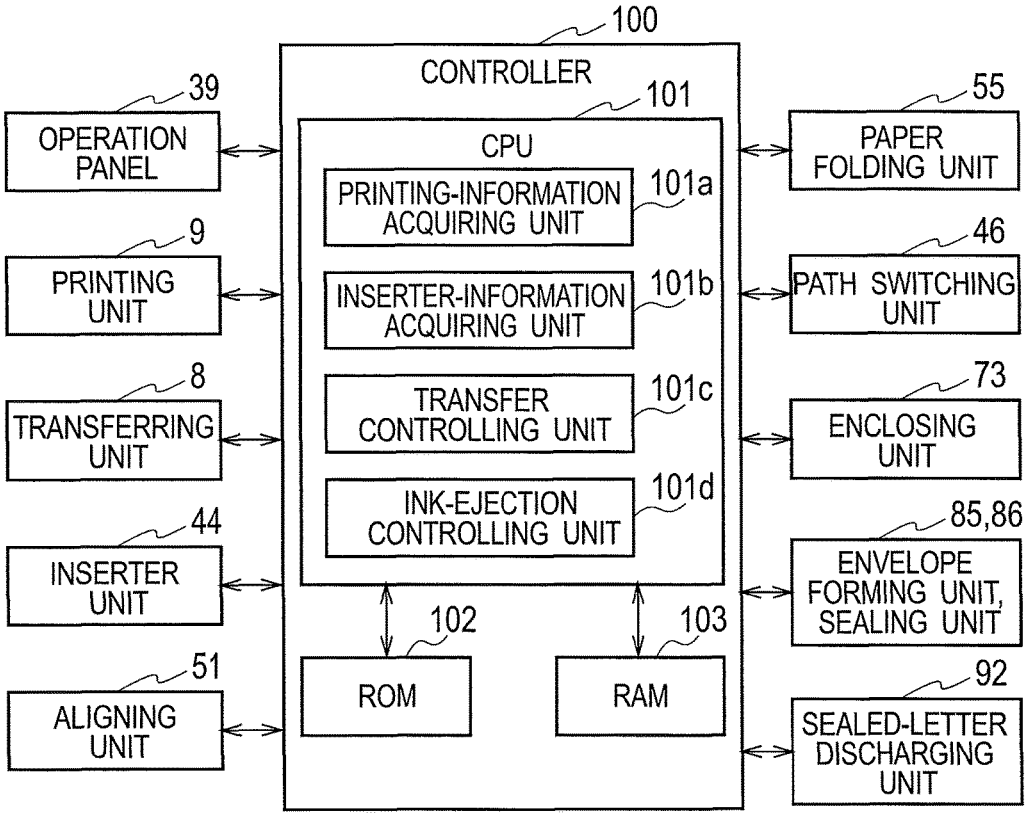
FIG. 5 is a functional configuration diagram illustrating a functional configuration of the enclosing and sealing system according to the first embodiment of the present invention.

FIG. 5 is a diagram illustrating a functional configuration of an enclosing and sealing system according to an embodiment of the present invention.

As illustrated in FIG. 5, a controller 100 is provided at an appropriate position within the image forming device 3. This controller 100 includes a program ROM 102 that stores, for example, a control program concerning printing processing, enclosing, and sealing, a RAM 103, and a CPU 101 that executes a control program concerning enclosing and sealing. The RAM 103 stores information necessary for performing enclosing/sealing processing, which includes, for example, setting information on the envelope sheet P2 inputted through an operation panel 39 or a computer device (not illustrated), printing jobs for the content sheet P1, and placement information concerning the insert sheet P3. Here, the printing job for the content sheet P1 includes information on a printing mode such as a duplex-printing mode and a single-sided mode, the size of sheet, and the number of sheets.

The placement information concerning the insert sheet P3 includes, for example, image direction information indicating positional relationship of an image formed on the insert sheet P3 with respect to the bound end P3*a*, and image-face direction information on the insert sheet P3 set on the paper feed tray 44*a*. The image direction information corresponds to information indicating the top/bottom direction of the insert sheet P3, and indicates that the insert sheet P3 is in the "top direction state" or the "bottom direction state." Furthermore, the image-face direction information corresponds to information indicating the surface/obverse direction of the insert sheet P3, and indicates that the insert sheet P3 is in the "surface direction state" or the "obverse direction state."

This controller 100 is connected, for example, with the operation panel 39 described above, the printing unit 9, a transferring unit 8, the inserter unit 44, the aligning unit 51, the paper folding unit 55, the path switching unit 46, the enclosing unit 73, the envelope forming unit 85, the sealing unit 86, and the sealed-letter discharging unit 92.

The controller 100 executes the control program stored in the program ROM 102 on the basis of the information necessary for performing enclosing and sealing processing, for example, to the content sheet P1, the insert sheet P3, and the envelope sheet P2 and acquired from the operation panel 39 or the computer device. At this time, the control program is executed in the controller 100 in a cooperative manner, for example, with the printing unit 9, the transferring unit 8, the inserter unit 44, the aligning unit 51, the paper folding unit 55, the path switching unit 46, the enclosing unit 73, the envelope forming unit 85, the sealing unit 86, and the sealed-letter discharging unit 92, whereby the enclosing and sealing processing is performed.

It should be noted that the transferring unit 8 is composed of a group of motors including, for example, the first transferring motor to the ninth transferring motor that rotate and drive the plural pairs of transferring rollers described above. Each of the transferring motors is designed so as to be controlled through control of the CPU 101.

The CPU 101 includes a printing-information acquiring unit 101*a*, an inserter-information acquiring unit 101*b*, a transfer controlling unit 101*c*, and an ink-ejection controlling unit 101*d*.

The printing-information acquiring unit 101*a* is a module that acquires a printing job from the operation panel 39 or computer device (not illustrated). The printing job contains, for example, image data for the content sheet P1, and setting information concerning enclosing and sealing. These pieces of information are sent to the transfer controlling unit 101*c* and the ink-ejection controlling unit 101*d*.

The inserter-information acquiring unit 101*b* is a module that acquires placement information (image direction information and image-face direction information) on the insert sheet P3 set on the paper feed tray 44*a*. In this embodiment, the inserter-information acquiring unit 101*b* acquires, for example, the top/bottom direction and the surface/obverse direction of the insert sheet P3 as the placement information through the operation panel 39. Here, the image direction information (information on directions of an image formed on the insert sheet P3) contains, for example, the top/bottom orientation of print contents with respect to the bound end P3*a*, and the orientation of a booklet fed (whether the bound end P3*a* serves as a leading edge or trailing edge with respect to the sheet feeding direction). The image-face direction information (information on a face of the image formed on the insert sheet P3) contains, for example, information as to whether the front cover side serves as the upper surface or the lower surface. Furthermore, the inserter-information acquiring unit 101*b* transmits these pieces of information to the transfer controlling unit 101*c*.

It should be noted that the operation panel 39 displays, on a screen, an orientation of the insert sheet P3 set on the paper feed tray 44*a*. With this screen display, a user is instructed about the orientation of the insert sheet P3 set on the paper feed tray 44*a*. In this embodiment, displayed is an instruction that the insert sheet P3 be placed so that the bound end P3*a* is positioned on the downstream side of the paper feed tray 44*a* in the transfer direction. Furthermore, in the case where the user sets the insert sheet P31, which is in the "top direction state," the operation panel 39 displays, on the screen, an instruction for the user to place the insert sheet P3 in the "obverse direction state." In the case where the user sets the insert sheet P32, which is in the "bottom direction state," the operation panel 39 displays, on the screen, an instruction for the user to place the insert sheet P3 in the "surface direction state."

The transfer controlling unit 101*c* is a module that controls drive of all the transfer units within the image forming device 3 and the sealed-letter preparing device 5, and drive of, for example, the aligning unit 51, the paper folding unit 55, the path switching unit 46, the enclosing unit 73, the envelope forming unit 85, the sealing unit 86, and the sealed-letter discharging unit 92 within the sealed-letter preparing device 5. The transfer controlling unit 101*c* functions as a paper-folding controller that switches the way of folding in the paper folding unit 55 between the folding outward and the folding inward in accordance with the information on the printing job, and the top/bottom direction and the surface/obverse direction of the insert sheet P3 sent by the inserter unit 44.

The transfer controlling unit 101*c* controls the paper folding unit 55 on the basis of placement information (image direction information and image-face direction information) on the insert sheet P3 acquired by the inserter-information acquiring unit 101*b*, to fold the content sheet P1. Here, the transfer controlling unit 101*c* controls the paper folding unit 55 so that an image formed on the external surface 131*a* of the upper-portion sheet 131 of the content sheet P1 has the same top/bottom direction as the insert sheet P3, to fold the content sheet P1.

Here, in the case where the content sheet P1 is folded outward, the upper-portion sheet 131, the middle-portion sheet 132, and the lower-portion sheet 133 are connected in this order (see FIG. 4A). In other words, once the content sheet P1 is opened up from a folded state, the middle-portion sheet 132 is located between the upper-portion sheet 131 and the lower-portion sheet 133.

On the other hand, in the case where the content sheet P1 is folded inward, the upper-portion sheet 131, the lower-portion sheet 133, and the middle-portion sheet 132 are connected in this order (see FIG. 4B). In other words, once the content sheet P1 is opened up from a folded state, the lower-portion sheet 133 is located between the upper-portion sheet 131 and the middle-portion sheet 132.

The ink-ejection controlling unit 101*d* is a module that controls the ink heads 11A, 11B, 11C, and 11D to eject inks onto the content sheet P1, thereby forming an image thereon. In this embodiment, the order of printing performed on the front surface and the rear surface of the content sheet P1 is changed, or the top/bottom direction of the image on the content sheet P1 is inverted, or other processing is performed on the basis of the placement information on the insert sheet P3 acquired by the inserter-information acquiring unit 101*b*.

Here, in the transfer controlling unit 101*c* and the ink-ejection controlling unit 101*d*, processing of matching the top/bottom directions and the surface/obverse directions of the content sheet P1 and the insert sheet P3 is performed on the basis of the placement information on the insert sheet P3 set on the paper feed tray 44*a*. More specifically, the transfer controlling unit 101*c* and the ink-ejection controlling unit 101*d* perform processing on the basis of information on printing modes for a printing job acquired from the printing-information acquiring unit 101*a*, and the placement information acquired from the inserter-information acquiring unit 101*b*. The placement information contains image direction information indicating the top/bottom direction of the insert sheet P3, and image-face direction information indicating the surface/obverse direction of the insert sheet P3.

Below, processes of matching the top/bottom direction of the content sheet P1 with the top/bottom direction of the insert sheet P3 will be described in detail. FIG. 6 to FIG. 11 are explanatory diagrams illustrating printing processing and enclosing processing according to placement information (image direction information and image-face direction information). Note that, here, a case where the insert sheet P3 is in the "top direction state" and a case where the insert sheet P3 is in the "bottom direction state" are separately described.

<In the Case where the Insert Sheet P3 is in the "Top Direction State">

First, description will be made of processes performed in the case where the insert sheet P3 is in the "top direction state."

Figure 6:
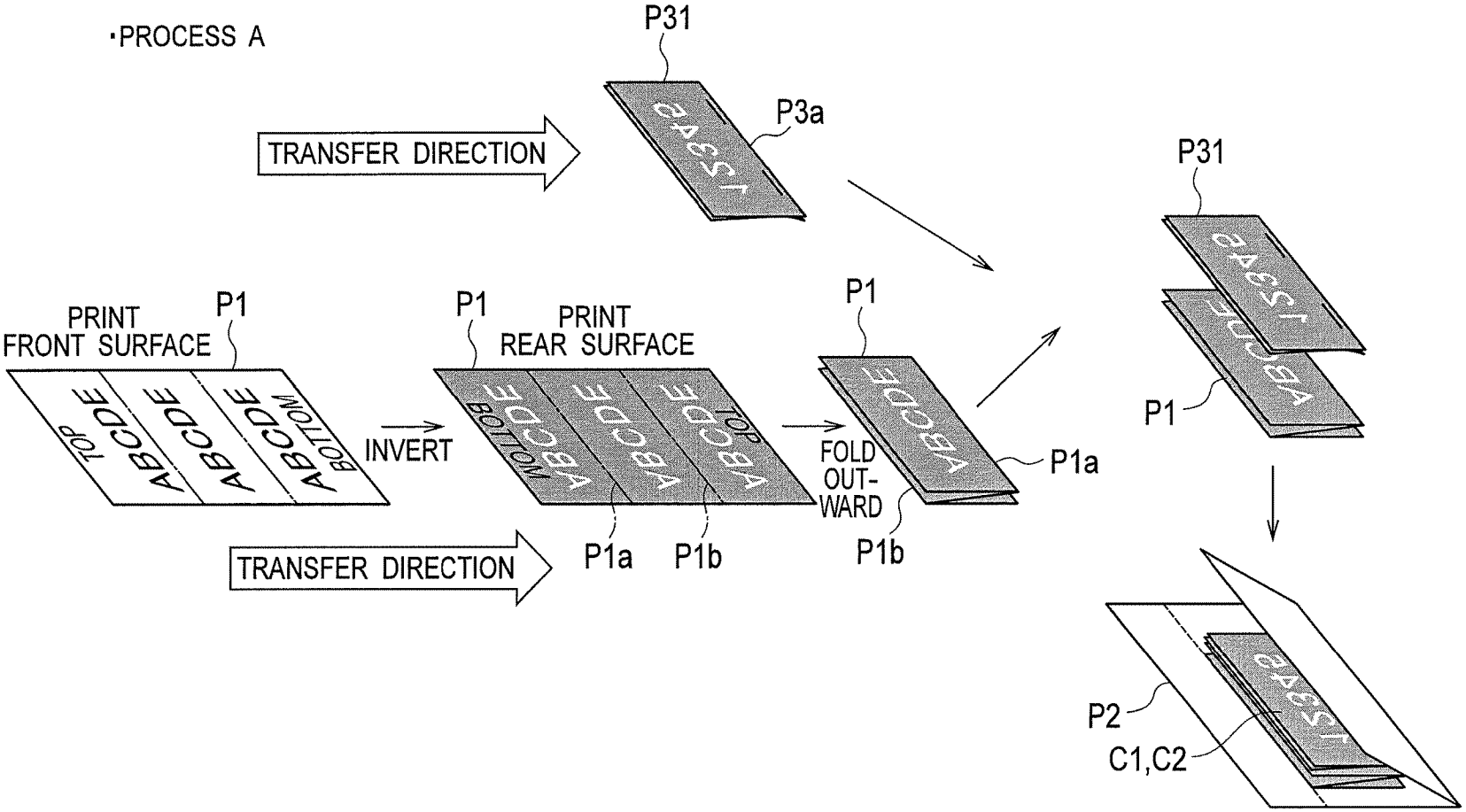
FIG. 6 is an explanatory diagram illustrating printing processing (duplex printing) and enclosing processing in the case where an insert sheet according to the first embodiment of the present invention is in a "top direction state" and an "obverse direction state."
Figure 7:
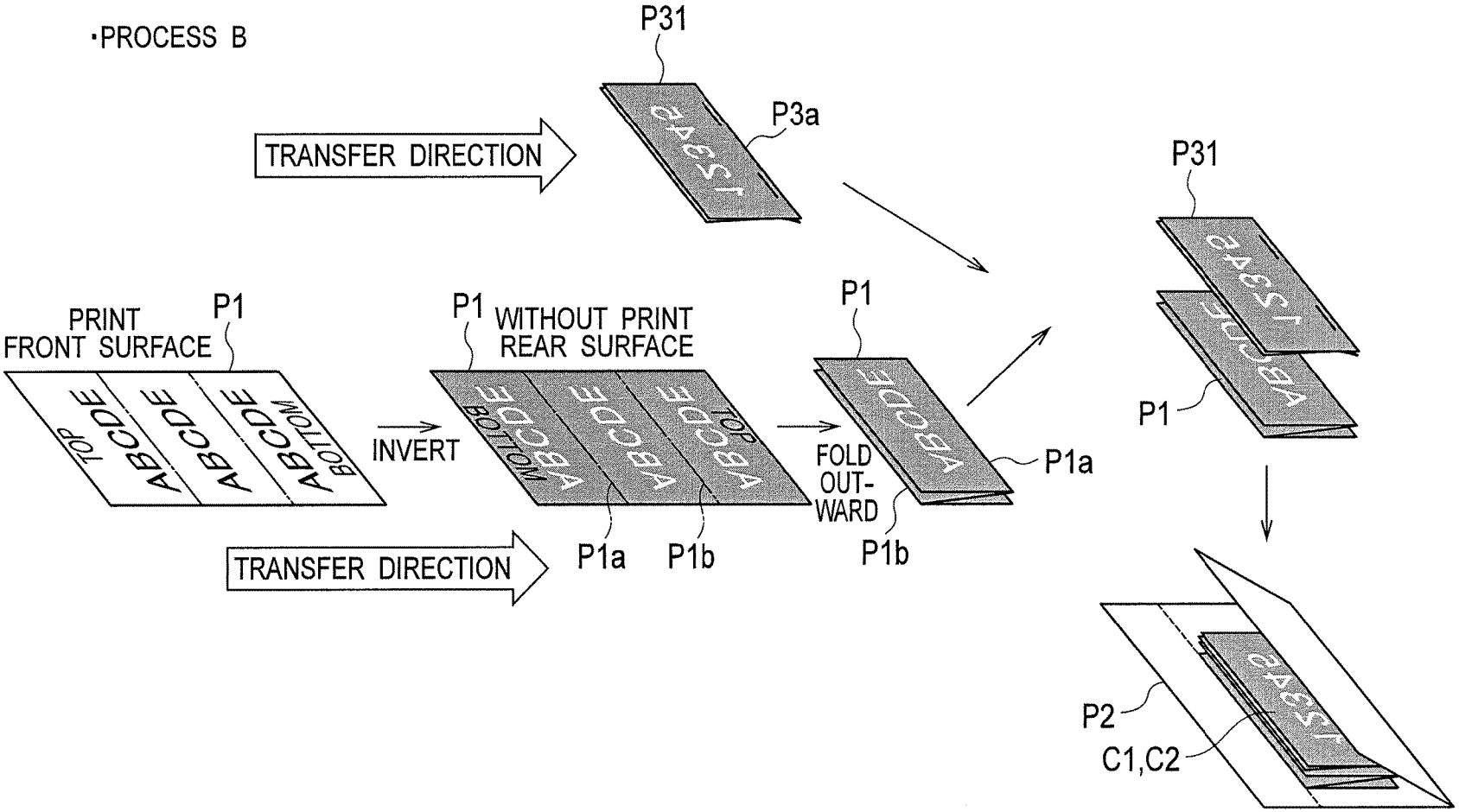
FIG. 7 is an explanatory diagram illustrating printing processing (single-sided printing) and enclosing processing in the case where the insert sheet according to the first embodiment of the present invention is in a "top direction state" and an "obverse direction state."
Figure 8:
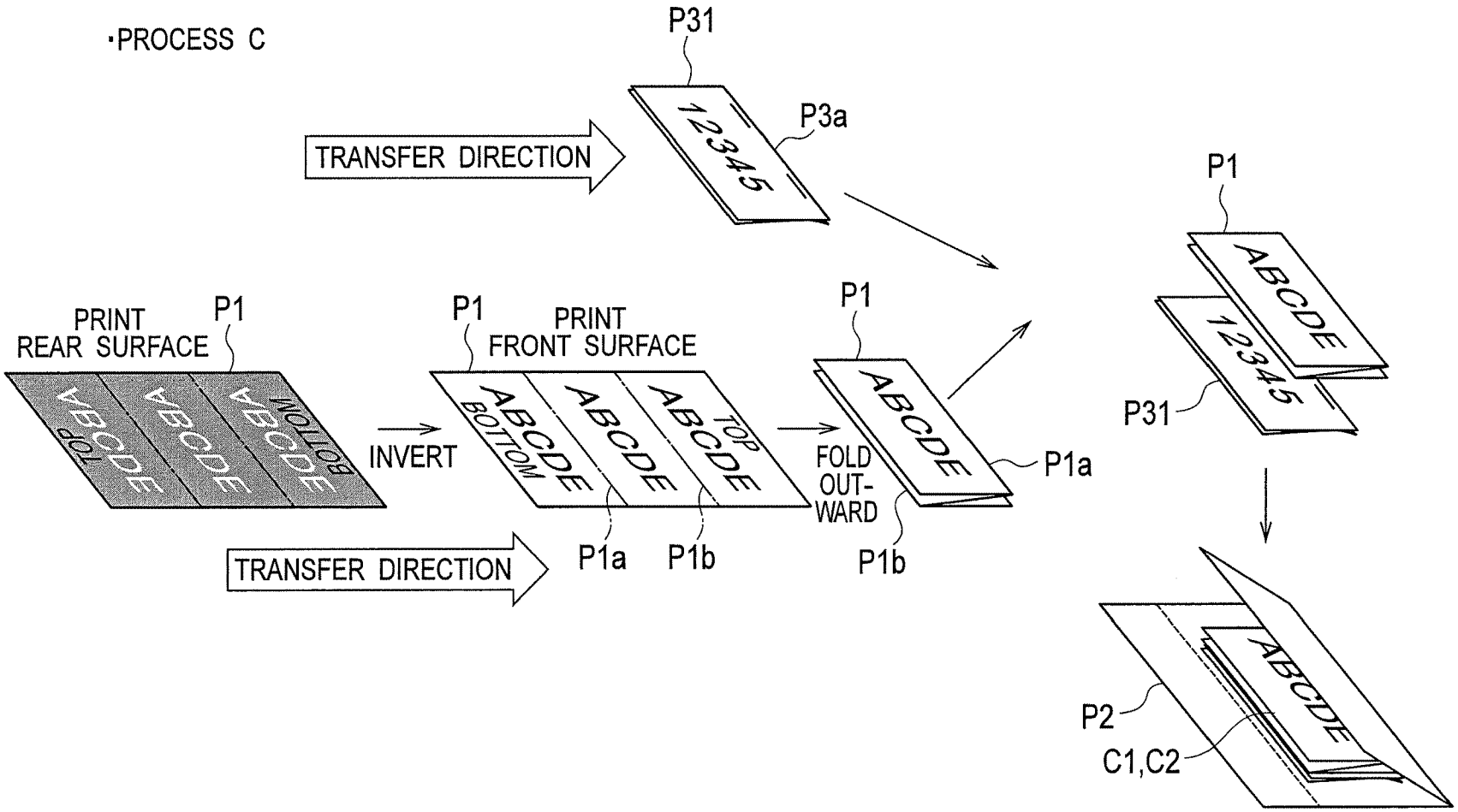
FIG. 8 is an explanatory diagram illustrating printing processing and enclosing processing in the case where the insert sheet according to the first embodiment of the present invention is in a "top direction state" and a "surface direction state."

FIG. 6 and FIG. 7 are explanatory diagrams illustrating printing processing and enclosing processing in the case where the insert sheet according to the first embodiment is in the "top direction state" and the "obverse direction state." FIG. 6 illustrates processes at the time of duplex printing. FIG. 7 illustrates processes at the time of single-sided printing. FIG. 8 is an explanatory diagram illustrating printing processing and enclosing processing in the case where the insert sheet according to the first embodiment is in the "top direction state" and the "surface direction state."

(1) Process A

Description will be made of a process A in the case where the insert sheet P3 is set in the "obverse direction state," and duplex printing is performed on the content sheet P1.

In the case where the insert sheet P3 is set in the "top direction state" as illustrated in FIG. 6 and the printing mode is set to duplex printing, the ink-ejection controlling unit 101*d* controls the ink head 11 within the image forming device 3 so as to rotate a page image on the front surface by 180 degrees to invert the top/bottom direction with respect to the printing direction, thereby to perform printing from the "bottom side" to the "top side." Next, the transfer controlling unit 101*c* transfers the content sheet P1, the front surface of which has a page image printed thereon, to the switchback transfer path 33 to invert the surface/obverse direction of the content sheet P1. Then, the ink-ejection controlling unit 101*d* prints a page image on the rear surface from the "top side" to the "bottom side." Unlike printing of the page image on the front surface, it is not necessary to invert the top/bottom direction with respect to the printing direction at the time of printing the page image on the rear surface. After the page image is printed on the rear surface of the sheet, the content sheet P1 is transferred to the sealed-letter preparing device 5.

The content sheet P1 is transferred to the content sheet transfer path 45, and is folded in outer threefold in the paper folding unit 55. Here, valley fold is made on the folding line P1*b* located on the downstream side in the transfer direction, and mountain fold is made on the folding line P1*a* located on the upstream side in the transfer direction. These operations generate a printed sheet in which an image ("ABCDE" on the first portion from the "top side" on the content sheet P1 in FIG. 6. Hereinafter, simply referred to as an image located at the top) located at the top on the content sheet P1 is shown on the external surface 133*a* of the lower-portion sheet 133.

The path is switched by the path switching unit 46 as illustrated in FIG. 3B, and the content sheet P1 that has been folded is transferred on the lower transfer path 45*b*. After this, the insert sheet P31 and the content sheet P1 merge in the merging unit 48. Then, the insert sheet P31 and the content sheet P1 are overlapped in a state where the insert sheet P31 is located on the upper part, and the content sheet P1 is located on the lower part, and are enclosed in the envelope sheet P2 in this state.

With these sheets being overlapped in such a way, the insert sheet P31 is in the "obverse direction state" in which the surface image ("12345" in the drawing) on the first page is displayed on the lower surface, and the content sheet P1 is also in the "obverse direction state" in which the image ("ABCDE" in the drawing) located at the top on the content sheet P1 is displayed on the external surface 133*a* of the lower-portion sheet 133. Thus, the insert sheet P31 and the content sheet P1 both have the same surface/obverse direction. In addition, the insert sheet P31 is oriented in a manner such that the "top side" of the surface image ("12345" in the drawing) on the first page is located on the downstream side in the transfer direction, and the content sheet P1 is oriented in a manner such that the "top side" of the image ("ABCDE" in the drawing) located at the top on the content sheet P1 is located on the downstream side in the transfer direction. Thus, the top/bottom direction of the upper-portion sheet 131 of the content sheet P1 matches the top/bottom direction of the insert sheet P3.

(2) Process B

Next, description will be made of a process B in the case where the insert sheet P3 is set in the "obverse direction state," and single-sided printing is performed on the content sheet P1.

In the case where the insert sheet P3 is set in the "obverse direction state" as illustrated in FIG. 7, and the printing mode is set to single-sided printing, the ink-ejection controlling unit 101*d* controls the ink head 11 within the image forming device 3 so as to rotate a page image on the front surface by 180 degrees to invert the top/bottom direction with respect to the printing direction, thereby to perform printing from the "bottom side" to the "top side." Next, the transfer controlling unit 101*c* transfers the content sheet P1, the front surface of which has a page image printed thereon, to the switchback transfer path 33 to invert the surface/obverse direction of the content sheet P1. Then, the content sheet P1 is transferred to the sealed-letter preparing device 5 without the rear surface of the content sheet P1, which has been inverted, being subjected to printing processing.

The content sheet P1 is transferred to the content sheet transfer path 45, and is folded in outer threefold in the paper folding unit 55. Here, valley fold is made on the folding line P1*b* located on the downstream side in the transfer direction, and mountain fold is made on the folding line P1*a* located on the upstream side in the transfer direction. These operations generate a printed sheet in which an image located at the top on the content sheet P1 is shown on the external surface 133*a* of the lower-portion sheet 133.

The path is switched by the path switching unit 46 as illustrated in FIG. 3B, and the content sheet P1 that has been folded is transferred on the lower transfer path 45*b*. After this, the insert sheet P31 and the content sheet P1 merge in the merging unit 48. Then, the insert sheet P31 and the content sheet P1 are overlapped in a state where the insert sheet P31 is located on the upper part, and the content sheet P1 is located on the lower part, and are enclosed in the envelope sheet P2 in this state.

With these sheets being overlapped in such a way, the insert sheet P31 is in the "obverse direction state" in which the surface image ("12345" in the drawing) on the first page is displayed on the lower surface, and the content sheet P1 is also in the "obverse direction state" in which the image ("ABCDE" in the drawing) located at the top on the content sheet P1 is displayed on the external surface 133*a* of the lower-portion sheet 133. Thus, the insert sheet P31 and the content sheet P1 both have the same surface/obverse direction. In addition, the insert sheet P31 is oriented in a manner such that the "top side" of the surface image ("12345" in the drawing) on the first page is located on the downstream side in the transfer direction, and the content sheet P1 is oriented in a manner such that the "top side" of the image ("ABCDE" in the drawing) located at the top on the content sheet P1 is located on the downstream side in the transfer direction. Thus, the top/bottom direction of the upper-portion sheet 131 of the content sheet P1 matches the top/bottom direction of the insert sheet P3.

(3) Process C

Next, description will be made of a process C in the case where the insert sheet P3 is set in the "surface direction state."

In the case where the insert sheet P3 is set in the "top direction state" and the "surface direction state" as illustrated in FIG. 8, the ink-ejection controlling unit 101*d* forms images in a predetermined order.

Here, at the time of duplex printing, the ink-ejection controlling unit 101*d* controls the ink head 11 within the image forming device 3 to print a page image on the rear surface of the sheet, and then, print a page image on the front surface. More specifically, the ink-ejection controlling unit 101*d* rotates the page image on the rear surface by 180 degrees to invert the top/bottom direction with respect to the printing direction, thereby to perform printing from the "bottom side" to the "top side." Then, the transfer controlling unit 101*c* transfers the content sheet P1 having the page image printed on the rear surface thereof to the switchback transfer path 33, to invert the surface/obverse direction of the content sheet P1. The ink-ejection controlling unit 101*d* performs printing from the "top side" to the "bottom side" without the top/bottom direction of the page image on the front surface of the sheet being inverted with respect to the printing direction. On the other hand, at the time of single-sided printing, printing is performed from the "top side" to the "bottom side" without the top/bottom direction of the page image on the front surface being inverted with respect to the printing direction, and the sheet is transferred to the sealed-letter preparing device 5 without invert processing being performed.

The content sheet P1, on which single-sided printing or duplex printing is performed, is transferred to the sealed-letter preparing device 5. The content sheet P1 is transferred to the content sheet transfer path 45, and is folded in outer threefold in the paper folding unit 55. Here, valley fold is made on the folding line P1*b* located on the downstream side in the transfer direction, and mountain fold is made on the folding line P1*a* located on the upstream side in the transfer direction. With these operations, the front surface of the upper-portion sheet 131 of the content sheet P1 is located outside the middle-portion sheet 132. Furthermore, here, prepared is a printed sheet in which the image located at the top on the content sheet P1 is shown on the inner surface 133*b* of the lower-portion sheet 133, and an image ("ABCDE" on the third portion from the "top side" on the content sheet P1 or on the first portion from the "bottom side" on the content sheet P1 in FIG. 8. Hereinafter, simply referred to as an image located at the bottom) located at the bottom on the front surface of the content sheet P1 is displayed on the external surface 131*a* of the upper-portion sheet 131.

The path is switched by the path switching unit 46 as illustrated in FIG. 3A, and the content sheet P1 that has been folded is transferred on the upper transfer path 45*a*. After this, the insert sheet P31 and the content sheet P1 merge in the merging unit 48. Then, the insert sheet P31 and the content sheet P1 are overlapped in a state where the content sheet P1 is located on the upper part, and the insert sheet P31 is located on the lower part, and are enclosed in the envelope sheet P2 in this state.

With these sheets being overlapped in such a way, the insert sheet P31 is in the "surface direction state" in which the surface image ("12345" in the drawing) on the first page is displayed on the upper surface, and the content sheet P1 is also in the "surface direction state" in which the image ("ABCDE" in the drawing. Note that this image is not the image located at the top) located at the bottom on the content sheet P1 is displayed on the external surface 131*a* of the upper-portion sheet 131. Thus, the insert sheet P31 and the content sheet P1 both have the same surface/obverse direction. In addition, the insert sheet P31 is oriented in a manner such that the "top side" of the surface image ("12345" in the drawing) on the first page is located on the downstream side in the transfer direction, and the content sheet P1 is oriented in a manner such that the "top side" of the image (note that this image is not the image located at the top) located at the bottom on the content sheet P1 is located on the downstream side in the transfer direction. Thus, the top/bottom direction of the upper-portion sheet 131 of the content sheet P1 matches the top/bottom direction of the insert sheet P3.

<In the Case where the Insert Sheet P3 is in the "Bottom Direction State">

Next, description will be made of processes performed in the case where the insert sheet P3 is in the "bottom direction state."

Figure 9:
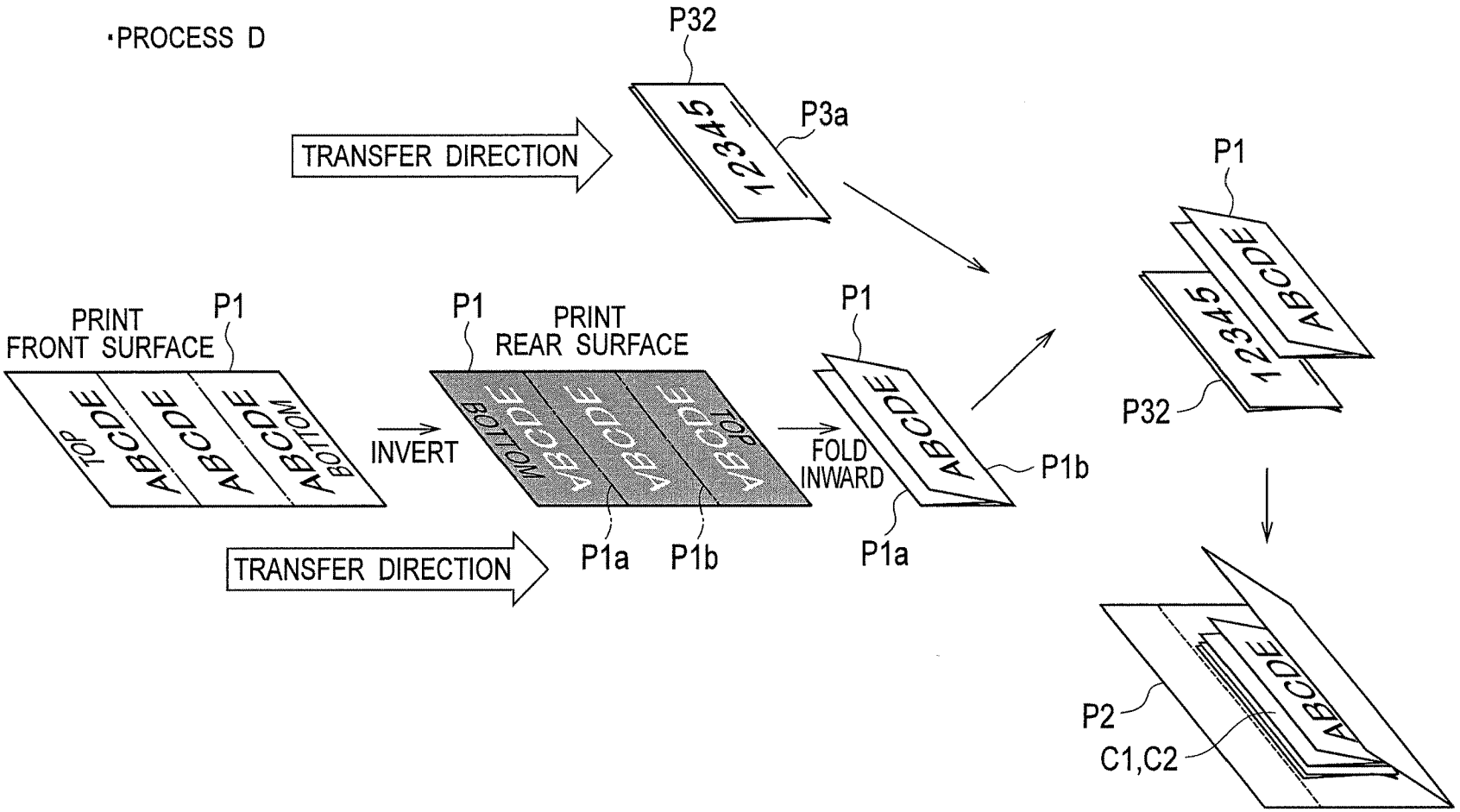
FIG. 9 is an explanatory diagram illustrating printing processing and enclosing processing in the case where the insert sheet according to the first embodiment of the present invention is in a "bottom direction state" and a "surface direction state."
Figure 10:
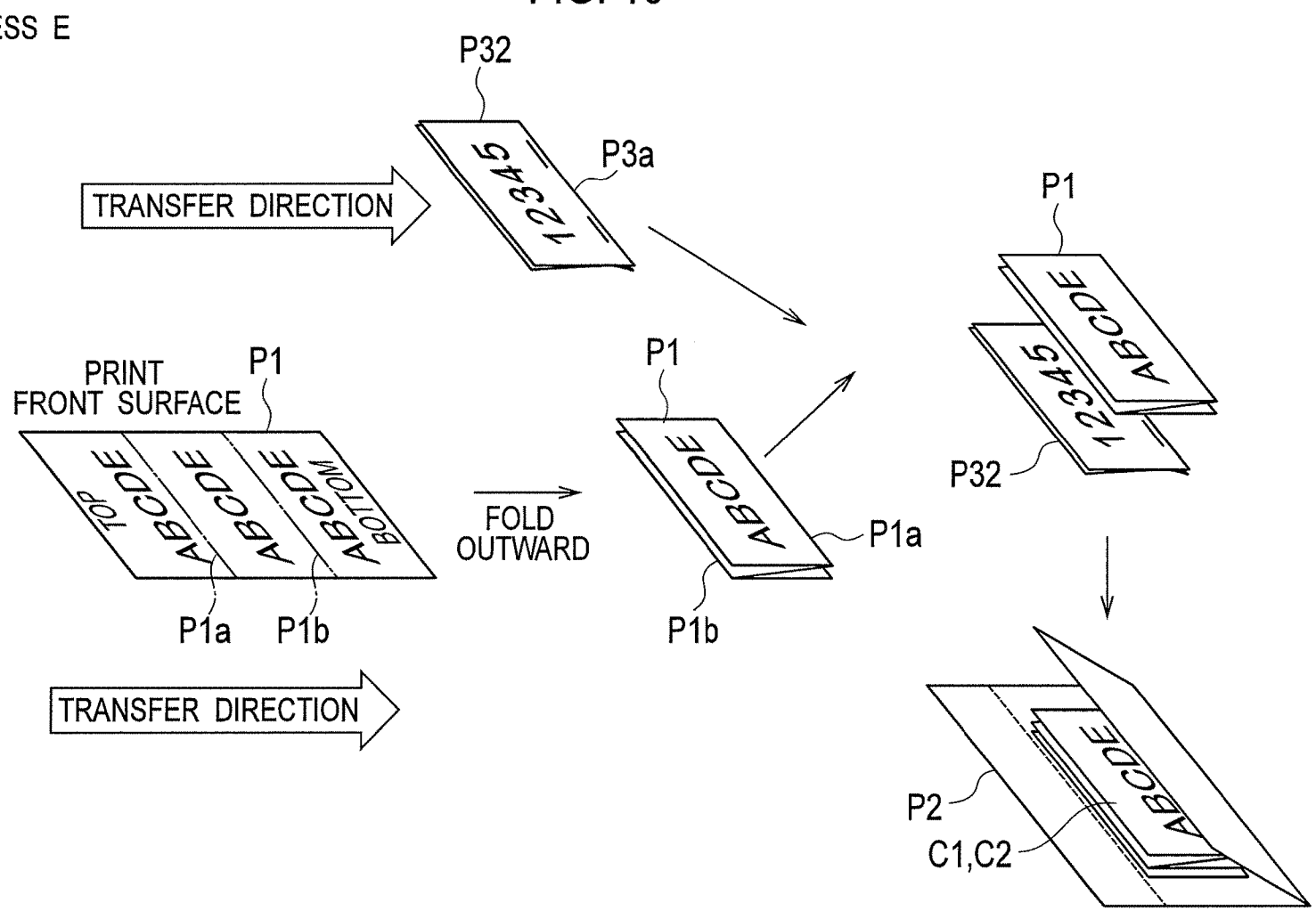
FIG. 10 is an explanatory diagram illustrating printing processing and enclosing processing in the case where the insert sheet according to the first embodiment of the present invention is in a "bottom direction state" and a "surface direction state."
Figure 11:
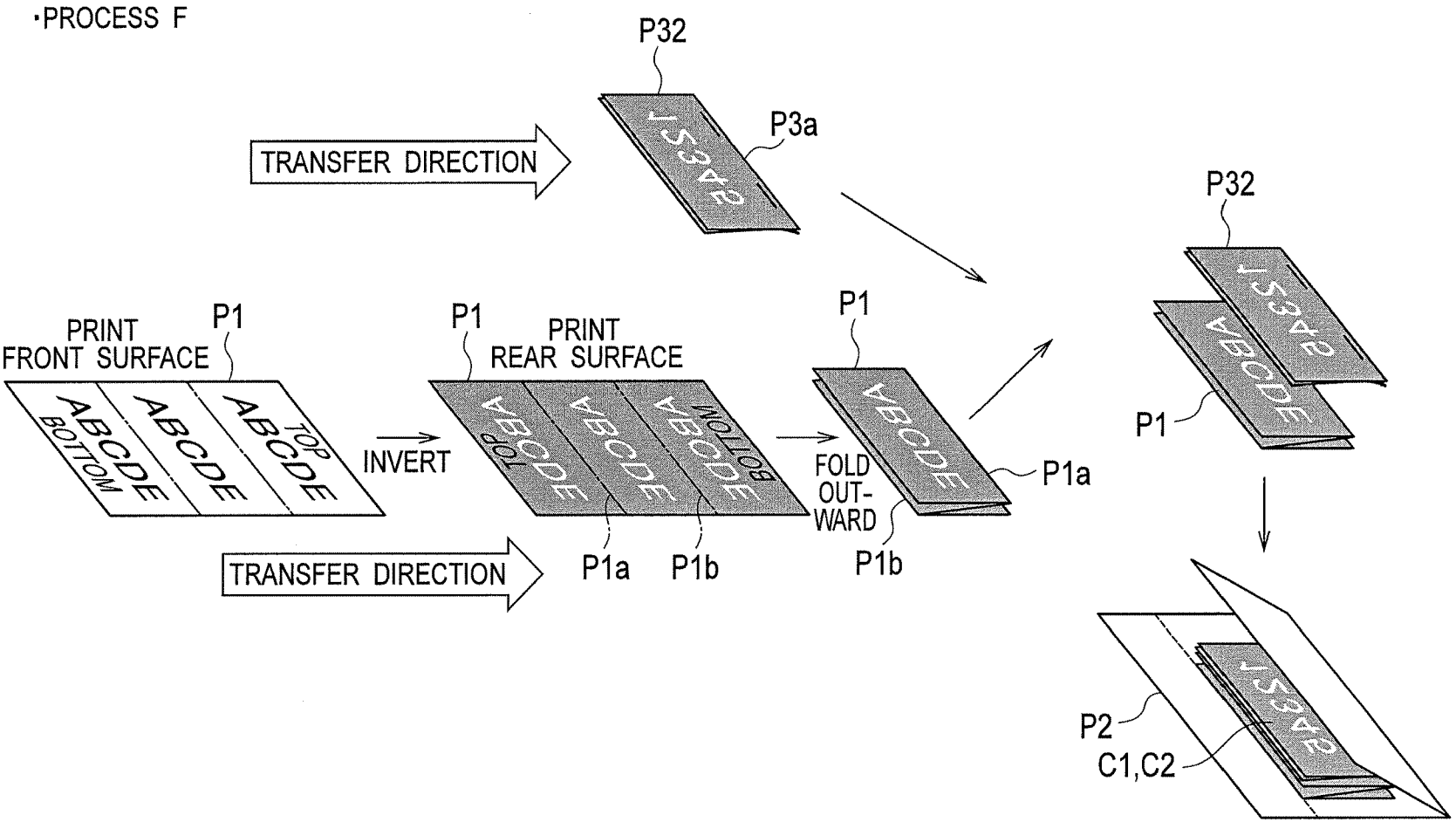
FIG. 11 is an explanatory diagram illustrating printing processing and enclosing processing in the case where the insert sheet according to the first embodiment of the present invention is in a "bottom direction state" and an "obverse direction state."

FIG. 9 and FIG. 10 are explanatory diagrams illustrating printing processing and enclosing processing in the case where the insert sheet according to the first embodiment is in the "bottom direction state" and the "surface direction state." FIG. 9 illustrates processes at the time of duplex printing. FIG. 10 illustrates processes at the time of single-sided printing. Furthermore, FIG. 11 is an explanatory diagram illustrating printing processing and enclosing processing in the case where the insert sheet according to the first embodiment is in the "bottom direction state" and the "obverse direction state."

(1) Process D

Description will be made of a process D in the case where the insert sheet P3 is set in the "surface direction state," and duplex printing is performed on the content sheet P1.

In the case where the insert sheet P3 is set in the "bottom direction state" and the "surface direction state" as illustrated in FIG. 9, the ink-ejection controlling unit 101*d* controls the ink head 11 within the image forming device 3 to rotate a page image on the front surface by 180 degrees to invert the top/bottom direction with respect to the printing direction, thereby to perform printing from the "bottom side" to the "top side." Next, the transfer controlling unit 101*c* transfers the content sheet P1, the front surface of which has a page image printed thereon, to the switchback transfer path 33 to invert the surface/obverse direction of the content sheet P1. Then, the ink-ejection controlling unit 101*d* prints a page image on the rear surface from the "top side" to the "bottom side." Unlike printing of the page image on the front surface, it is not necessary to invert the top/bottom direction with respect to the printing direction at the time of printing the page image on the rear surface. After the page image is printed on the rear surface of the sheet, the content sheet P1 is transferred to the sealed-letter preparing device 5.

The content sheet P1 is transferred to the content sheet transfer path 45, and is folded in inner threefold in the paper folding unit 55. Here, the folding line P1*a* located on the upstream side in the transfer direction is folded, and then, the folding line P1*b* located on the downstream side in the transfer direction is folded. There operations generate a printed sheet in which an image ("ABCDE" in the drawing) located at the top on the content sheet P1 is displayed on the external surface 131*a* of the upper-portion sheet 131.

The path is switched by the path switching unit 46 as illustrated in FIG. 3A, and the content sheet P1 that has been folded is transferred on the upper transfer path 45*a*. After this, the insert sheet P32 and the content sheet P1 merge in the merging unit 48. Then, the insert sheet P32 and the content sheet P1 are overlapped in a state where the content sheet P1 is located on the upper part, and the insert sheet P32 is located on the lower part, and are enclosed in the envelope sheet P2 in this state.

With these sheets being overlapped in such a way, the insert sheet P32 is in the "surface direction state" in which the surface image ("12345" in the drawing) on the first page is displayed on the upper surface, and the content sheet P1 is also in the "surface direction state" in which the image ("ABCDE" in the drawing) located at the top on the content sheet P1 is displayed on the external surface 131*a* of the upper-portion sheet 131. Thus, the insert sheet P32 and the content sheet P1 both have the same surface/obverse direction. In addition, the insert sheet P32 is oriented in a manner such that the "top side" of the surface image ("12345" in the drawing) on the first page is located on the upstream side in the transfer direction, and the content sheet P1 is oriented in a manner such that the "top side" of the image ("ABCDE" in the drawing) located at the top on the content sheet P1 is located on the upstream side in the transfer direction. Thus, the top/bottom direction of the upper-portion sheet 131 of the content sheet P1 matches the top/bottom direction of the insert sheet P3.

(2) Process E

Next, description will be made of a process E in the case where the insert sheet P3 is set in the "surface direction state," and the printing mode is set to single-sided printing.

In the case where the insert sheet P3 is set in the "bottom direction state" and the "surface direction state" as illustrated in FIG. 10, the ink-ejection controlling unit 101*d* controls the ink head 11 within the image forming device 3 so as to rotate a page image on the front surface by 180 degrees to invert the top/bottom direction with respect to the printing direction, thereby to perform printing from the "bottom side" to the "top side." The content sheet P1 having the front surface having a page image printed thereon is transferred to the sealed-letter preparing device 5.

The content sheet P1 is transferred to the content sheet transfer path 45, and is folded in outer threefold in the paper folding unit 55. Here, valley fold is made on the folding line P1*b* located on the downstream side in the transfer direction, and mountain fold is made on the folding line P1*a* located on the upstream side in the transfer direction. These operations generate a printed sheet in which an image ("ABCDE" in the drawing) located at the top on the content sheet P1 is shown on the external surface 131*a* of the upper-portion sheet 131.

The path is switched by the path switching unit 46 as illustrated in FIG. 3A, and the content sheet P1 that has been folded is transferred on the upper transfer path 45*a*. After this, the insert sheet P32 and the content sheet P1 merge in the merging unit 48. Then, the content sheet P1 and the insert sheet P32 are overlapped in a state where the content sheet P1 is located on the upper part, and the insert sheet P32 is located on the lower part, and are enclosed in the envelope sheet P2 in this state.

With these sheets being overlapped in such a way, the insert sheet P32 is in the "surface direction state" in which the surface image ("12345" in the drawing) on the first page is displayed on the upper surface, and the content sheet P1 is also in the "surface direction state" in which the image ("ABCDE" in the drawing) located at the top on the content sheet P1 is displayed on the external surface 131*a* of the upper-portion sheet 131. Thus, the insert sheet P32 and the content sheet P1 both have the same surface/obverse direction. In addition, the insert sheet P32 is oriented in a manner such that the "top side" of the surface image ("12345" in the drawing) on the first page is located on the upstream side in the transfer direction, and the content sheet P1 is oriented in a manner such that the "top side" of the image ("ABCDE" in the drawing) located at the top on the content sheet P1 is located on the upstream side in the transfer direction. Thus, the top/bottom direction of the upper-portion sheet 131 of the content sheet P1 matches the top/bottom direction of the insert sheet P3.

(3) Process F

Next, description will be made of a process F in the case where the insert sheet P3 is set in the "obverse direction state."

In the case where the insert sheet P3 is set in the "bottom direction state" and the "obverse direction state" as illustrated in FIG. 11, images are formed with the ink-ejection controlling unit 101*d* in a predetermined order.

In the case of duplex printing, the ink-ejection controlling unit 101*d* controls the ink head 11 within the image forming device 3 to print a page image on the front surface of the sheet, and then, print a page image on the rear surface. The ink-ejection controlling unit 101*d* first prints the page image on the front surface from the "top side" to the "bottom side" without the top/bottom direction of the page image being inverted. Then, the transfer controlling unit 101*c* transfers the content sheet P1, the rear surface of which has the page image printed thereon, to the switchback transfer path 33 to invert the surface/obverse direction of the content sheet P1. After this, the ink-ejection controlling unit 101*d* rotates the top/bottom direction of the page image on the rear surface by 180 degrees to invert the top/bottom direction with respect to the printing direction, thereby to perform printing from the "bottom side" to the "top side."

On the other hand, at the time of single-sided printing, the page image on the front surface is printed from the "top side" to the "bottom side" without the top/bottom direction of the page image being inverted. Then, the transfer controlling unit 101*c* transfers the content sheet P1, the rear surface of which has the page image printed thereon, to the switchback transfer path 33, inverts the surface/obverse direction of the content sheet P1, and transfers it without the rear surface being printed.

The content sheet P1 on which single-sided printing or duplex printing has been performed is transferred to the sealed-letter preparing device 5. The content sheet P1 is transferred to the content sheet transfer path 45, and is folded in outer threefold in the paper folding unit 55. Here, valley fold is made on the folding line P1*b* located on the downstream side in the transfer direction, and mountain fold is made on the folding line P1*a* located on the upstream side in the transfer direction. At this time, an image ("ABCDE" in the drawing) located at the top on the content sheet P1 is shown on the inner surface 131*b* of the upper-portion sheet 131. Then, generated is a printed sheet in which an image located at the bottom on the content sheet P1 is displayed on the external surface 133*a* of the lower-portion sheet 133.

The path is switched by the path switching unit 46 as illustrated in FIG. 3B, and the content sheet P1 that has been folded is transferred on the lower transfer path 45*b*. After this, the insert sheet P32 and the content sheet P1 merge in the merging unit 48. Then, the insert sheet P32 and the content sheet P1 are overlapped in a state where the insert sheet P32 is located on the upper part, and the content sheet P1 is located on the lower part, and are enclosed in the envelope sheet P2 in this state.

With these sheets being overlapped in such a way, the insert sheet P32 is in the "obverse direction state" in which the surface image ("12345" in the drawing) on the first page is displayed on the lower surface, and the content sheet P1 is also in the "obverse direction state" in which the image ("ABCDE" in the drawing. Note that this image is not the image located at the top) located at the bottom on the content sheet P1 is displayed on the external surface 133*a* of the lower-portion sheet 133. Thus, the insert sheet P32 and the content sheet P1 both have the same surface/obverse direction. In addition, the insert sheet P32 is oriented in a manner such that the "top side" of the surface image ("12345" in the drawing) on the first page is located on the upstream side in the transfer direction, and the content sheet P1 is also oriented in a manner such that the "top side" of the image (note that this image is not the image located at the top) located at the bottom on the content sheet P1 is located on the upstream side in the transfer direction. Thus, the top/bottom direction of the upper-portion sheet 131 of the content sheet P1 matches the top/bottom direction of the insert sheet P3.

<Operations of Sealed-Letter Preparing Device>

Figure 12A:
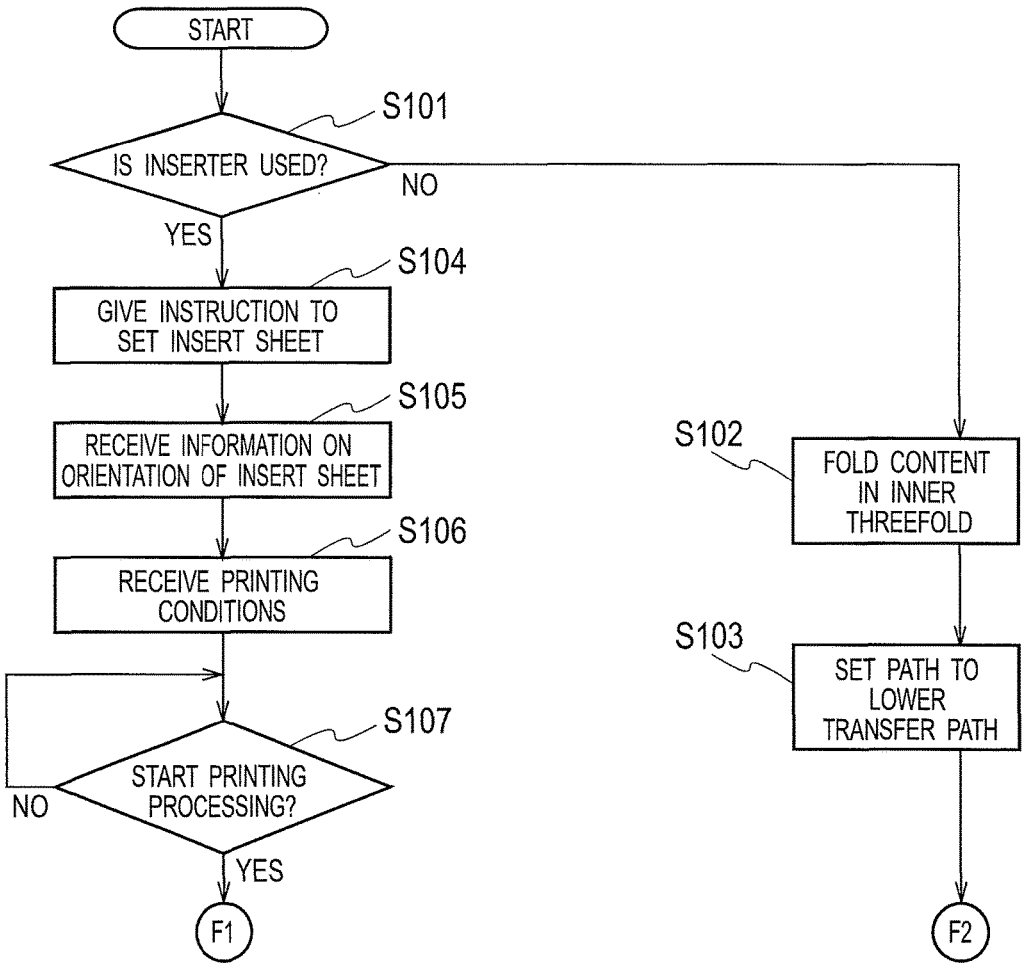
FIG. 12A is a flowchart showing an enclosing and sealing method according to the first embodiment of the present invention.
Figure 12B:
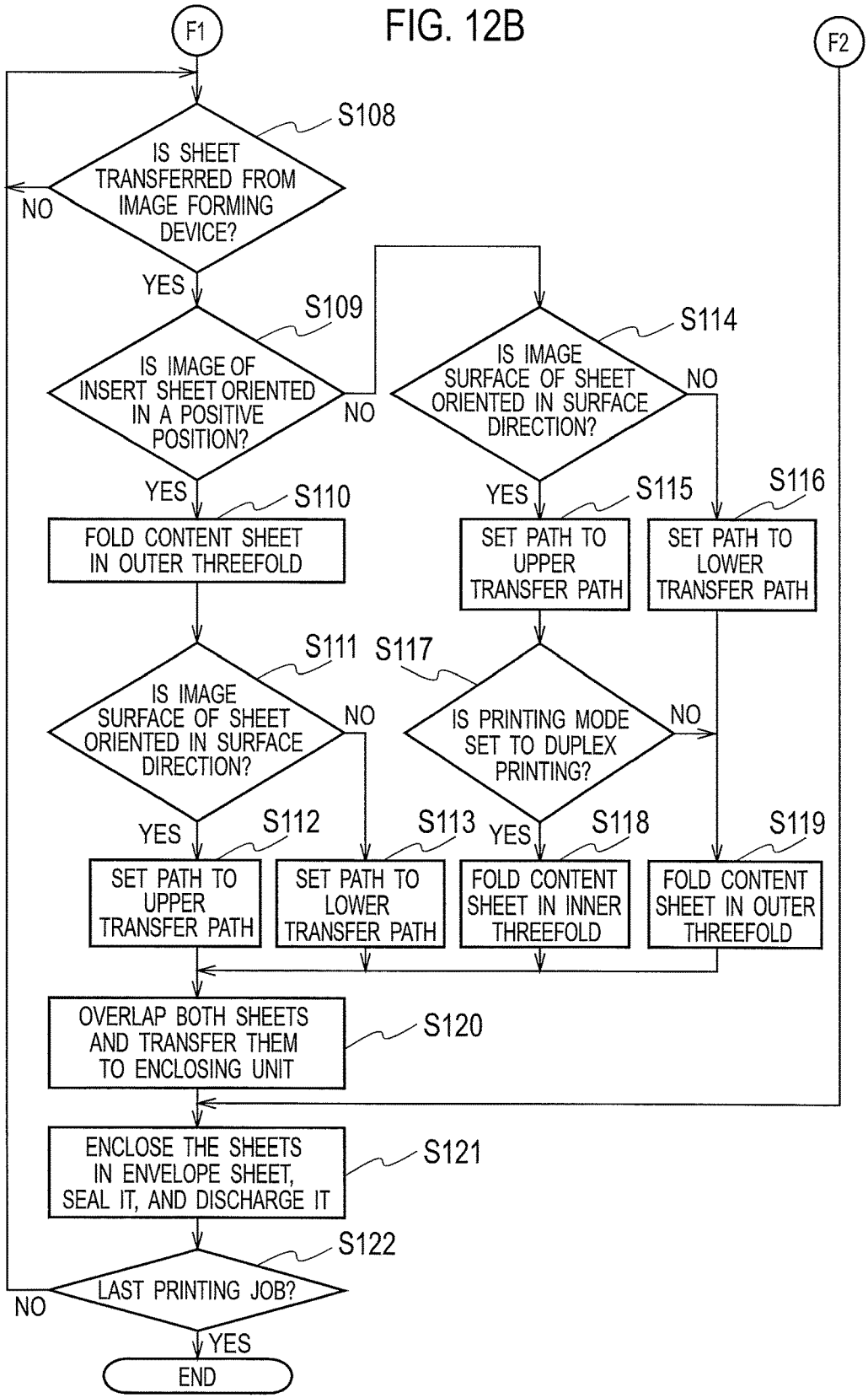
FIG. 12B is a flowchart showing an enclosing and sealing method according to the first embodiment of the present invention.

Next, operations of the enclosing and sealing system 1 according to an embodiment of the present invention will be described. FIG. 12A and FIG. 12B are flowcharts showing enclosing and sealing operations of the enclosing and sealing system 1 according to an embodiment of the present invention.

First, the CPU 101 acquires operation signals from the operation panel 39 or the computer device, and determines whether or not to insert the insert sheet P3 using the inserter unit 44 to perform enclosing and sealing (step S101).

In the case where the insert sheet P3 is not inserted ("NO" in step S101), the CPU 101 sets the setting of the paper folding unit 55 to inner threefold (step S102), and controls the path switching unit 46 so as to transfer the sheet on the lower transfer path 45*b* (step S103). Then, the content sheet P1 is subjected to printing processing under the set conditions, and thereafter folded. Then, the content sheet P1 is enclosed in the envelope sheet P2, and the sealed letter M is discharged (step S121).

On the other hand, in the case where the insert sheet P3 is inserted ("YES" in step S101), the CPU 101 causes the operation panel 39 to display information instructing the orientation in which the insert sheet P3 is set on the paper feed tray 44*a* (step S104). More specifically, the operation panel 39 displays, on its screen, information instructing to set the insert sheet P3 on the paper feed tray 44*a* so that the bound end P3*a* thereof is directed to the downstream side in the transfer direction. Furthermore, as for the insert sheet P31 having an image formed so that the "top side" thereof is located on the bound end P3*a* side, the operation panel 39 displays information instructing to set the insert sheet P3 so that the front surface thereof faces the rear side (downward). In addition, as for the insert sheet P32 having an image formed so that the "bottom side" thereof is located on the bound end P3*a* side, the operation panel 39 displays information instructing to set the insert sheet P3 so that the front surface thereof faces the front side (upward).

After this, the insert sheet P3 is set on the paper feed tray 44*a* through operation by a user. If it is detected in the CPU 101 that the insert sheet P3 has been set on the paper feed tray 44*a*, the CPU 101 causes the operation panel 39 to display a screen for inputting placement information of the insert sheet P3 set on the operation panel 39 on the insert sheet P3, and receives input of the placement information (step S105). More specifically, the operation panel 39 displays a screen for selecting image direction information on the insert sheet P3 with respect to the bound end P3*a*, and image-face direction information on the insert sheet P3. Furthermore, the inserter-information acquiring unit 101*b* acquires the image direction information on the insert sheet P3 with respect to the bound end P3*a* and the image-face direction information on the insert sheet P3 on the basis of the selection by the user.

Furthermore, the operation panel 39 displays a screen for receiving settings for the content sheet P1. At this time, the operation panel 39 receives a selection of printing mode (single-sided printing mode or duplex-printing mode) for the content sheet P1 (step S106). Then, the CPU 101 waits until an operation for performing processing is received ("NO" in step S107), and upon receiving the operation for performing processing ("YES" in step S107), printing processing is performed on the content sheet P1.

In the case where printing processing is performed, the ink-ejection controlling unit 101*d* and the transfer controlling unit 101*c* perform printing processing on the basis of the printing mode and the placement information (the image direction information and the image-face direction information) on the insert sheet P3 while transferring the content sheet P1 as in the processes A to F described above. After this, in the sealed-letter preparing device 5, it is detected, using a detecting sensor on the lead-in transfer path 43, whether or not the content sheet P1 has been transferred from the image forming device 3 (step S108), and detecting processing is repeated until the detecting sensor detects that the content sheet P1 has been transferred (NO" in step S108).

If the detecting sensor detects that the content sheet P1 has been transferred ("YES" in step S108), the CPU 101 first determines whether or not the insert sheet P3 corresponding to the transferred content sheet P1 is in the "top direction state" (step S109). If the insert sheet P3 is in the "top direction state" ("YES" in step S109), the process A, the process B, and the process C are performed. In other words, it is determined that the content sheet P1 is folded in outer threefold regardless of whether the content sheet P1 is subjected to duplex printing or single-sided printing (step S110).

Next, the CPU 101 determines whether or not the insert sheet P3 is in the "surface direction state" (step S111). If the insert sheet P3 is in the "obverse direction state" ("NO" in step S111), the CPU 101 controls and sets the path switching unit 46 so as to transfer the content sheet P1 on the lower transfer path 45*b* (step S112). With this operation, an image surface of each of the sheets is in the "obverse direction state" as in the process A and the process B; an image on each of the sheets is oriented in a manner such that the "top side" thereof is located on the downstream side in the transfer direction; and the insert sheet P3 and the content sheet P1 both have the same surface/obverse direction and the same top/bottom direction.

On the other hand, if the image surface of the insert sheet P3 is in the "surface direction state" ("YES" in step S111), the CPU 101 controls and sets the path switching unit 46 so as to transfer the content sheet P1 on the upper transfer path 45*a* (step S113). With this operation, as in the process C, the image surface of each of the sheets is in the "surface direction state"; the image on each of the sheets is oriented in a manner such that the "top side" thereof is located on the downstream side in the transfer direction; and the insert sheet P3 and the content sheet P1 have the same surface/obverse direction and the same top/bottom direction.

On the other hand, if the insert sheet P3 is in the "bottom direction state" ("NO" in step S109), the CPU 101 determines whether or not an image surface of the insert sheet P3 is in the "surface direction state" (step S114). If the image surface of the insert sheet P3 is in the "obverse direction state" ("NO" in step S111), the CPU 101 controls and sets the path switching unit 46 so as to transfer the content sheet P1 on the lower transfer path 45*b* (step S116), and the content sheet P1 is folded in outer threefold (step S119) as in the process F. With this operation, as in the process F, the image surface of each of the sheets is in the "obverse direction state"; an image on each of the sheets is oriented in a manner such that "top side" thereof is located on the upstream side in the transfer direction; and the insert sheet P3 and the content sheet P1 both have the same surface/obverse direction and the same top/bottom direction.

On the other hand, if the insert sheet P3 is in the "surface direction state" ("YES" in step S114), the CPU 101 controls and sets the path switching unit 46 so as to transfer the content sheet P1 on the upper transfer path 45*a* (step S115). The CPU 101 determines whether or not the printing mode for the content sheet P1 is set to duplex printing (step S117). If the printing mode is set to duplex printing ("YES" in step S117), the process D described above is performed. In other words, it is determined that the content sheet P1 is folded in inner threefold (step S118). With this operation, an image surface of each of the sheets is in the "surface direction state" as in the process D; the image on each of the sheets is oriented in a manner such that the "top side" thereof is located on the upstream side in the transfer direction; and the insert sheet P3 and the content sheet P1 both have the same surface/obverse direction and the same top/bottom direction.

On the other hand, if the content sheet P1 is set to single-sided printing ("NO" in step S117), the process E described above is performed. In other words, it is determined that the content sheet P1 is folded in outer threefold (step S119). With this operation, the image surface of each of the sheets is in the "surface direction state" as in the process E; the image on each of the sheets is oriented in a manner such that the "top side" thereof is located on the upstream side in the transfer direction; and the insert sheet P3 and the content sheet P1 both have the same surface/obverse direction and the same top/bottom direction.

The insert sheet P3 and the content sheet P1, which are overlapped in a state where the surface/obverse direction and top/bottom direction thereof are matched with each other, are transferred to the enclosing unit 73, and are enclosed in the envelope sheet P2 in the enclosing unit 73 (step S120). Then, the envelope sheet P2 having each of the sheets contained therein is sealed in the envelope forming unit 85 and the sealing unit 86, and is discharged from the sealed-letter discharging unit 92 to the outside of the device (step S121). If other printing jobs exist ("NO" in step S122), the CPU 101 repeats processes from step S110 to step S119 described above, and if it is determined that the current job is the last printing job ("YES" in step S122), the processing ends.

(Operation and Effect)

According to this embodiment described above, in the case where the content sheet P1, which is folded in the paper folding unit 55, and the insert sheet P3, which is supplied from the inserter unit 44, are overlapped, and are enclosed in the envelope, it is possible to match the top/bottom direction and the surface/obverse direction of each of the contents enclosed. As a result, according to this sealed-letter preparing device 5, the content sheet P1 and the insert sheet P3 both have the same top/bottom direction when the recipient unseals the sealed letter, pulls out the content from the envelope and unfolds it, so that the recipient can easily read the content.

In particular, in this embodiment, the path switching unit 46 is controlled to switch the up-down positional relationship of the content sheet P1 and the insert sheet P3 to be sent to the transfer path, on the basis of placement information (image direction information and image-face direction information) concerning the top/bottom direction or the surface/obverse direction of the insert sheet P3 inserted by the inserter unit 44. Thus, a person who unseals the letter can further easily read the content when pulling out the content from the envelope and unfolding it.

Furthermore, in this embodiment, the content sheet P1 having an image formed thereon is folded, and the transfer path for the printed sheet fed from the inserter unit 44 is not changed, which makes it possible to prevent occurrence of transfer jam. In addition, in this embodiment, although no mechanism that inverts the direction of the content sheet P1 that has been folded is provided within the sealed-letter preparing device 5, the top/bottom direction and the surface/obverse direction of each of the sheets can be matched with each other, whereby it is possible to reduce the size of the device.

It should be noted that, in the first embodiment described above, it is configured such that each of the units is controlled, and enclosing and sealing processing is performed according to the top/bottom direction (image direction information) of the insert sheet P3, as in the processes C and F, regardless of the surface/obverse direction (image-face direction information) of the insert sheet P3. However, the configuration is not limited to this.

For example, it may be possible to employ a configuration in which: the surface/obverse direction of the insert sheet P3 is set according to the top/bottom direction (image direction information) of the insert sheet P3; error indication is displayed in the case where the insert sheet is set in a different surface/obverse direction; and processing thereafter is not performed.

In this case, the CPU 101 acquires placement information (image direction information and image-face direction information) from the inserter-information acquiring unit 101*b*, and then, determines whether or not the image direction information and the image-face direction information satisfy a set relationship. More specifically, if the CPU 101 refers to the image direction information and the top/bottom direction of the insert sheet P3 is indicated as the "top direction state," the CPU 101 refers to the image-face direction information, and determines whether or not the surface/obverse direction of the insert sheet P3 is in the "obverse direction state." Furthermore, if the CPU 101 refers to the image direction information and the top/bottom direction of the insert sheet P3 is indicated as the "bottom direction state," the CPU 101 refers to the image-face direction information, and determines whether or not the surface/obverse direction of the insert sheet P3 is in the "surface direction state."

Here, if the CPU 101 refers to the placement information (the image direction information and the image-face direction information) and determines that the insert sheet P3 is in the "top direction state" and the "surface direction state," the CPU 101 determines not to perform printing processing as well as enclosing and sealing processing by considering easiness for a user to read the content.

The relationship with the easiness for a user to read will be described in the following manner. In the first place, images representing more attractive information for users are arranged in the order from the "top side" to the "bottom side" on the insert sheet P3 in its unfolded state. However, in the case where the insert sheet P3 is in the "top direction state" and the "surface direction state," the process C described in the first embodiment is performed, which results in that the image located at the top on the content sheet P1 is located on the inner surface 133*b* of the lower-portion sheet 133. At this time, the user has to unfold the insert sheet P3 from a folded state to read the top image located on the "top side" of an image printed on the insert sheet P3. Thus, the user may feel awkwardness in reading when reading the information printed on the insert sheet P3. For this reason, in the case where the insert sheet P3 is determined to be in the "top direction state" and the "surface direction state," it is determined that printing processing and enclosing and sealing processing are not performed.

Here, if the placement information (the image direction information and the image-face direction information) is referred to and the insert sheet P3 is determined to be in the "bottom direction state" and the "obverse direction state," it is determined that printing processing as well as enclosing and sealing processing are not performed by considering easiness for a user to read the content.

If the insert sheet P3 is in the "bottom direction state" and the "obverse direction state," the process F described in the first embodiment is performed, which results in that the image located at the top on the content sheet P1 is located on the inner surface 131*b* of the upper-portion sheet 131. At this time, the user has to unfold the insert sheet P3 from a folded state to read the top image located on the "top side" of an image printed on the insert sheet P3. Thus, the user may feel awkwardness in reading when reading the information printed on the insert sheet P3. For this reason, in the case where the insert sheet P3 is determined to be in the "bottom direction state" and the "obverse direction state," it is determined that printing processing and enclosing and sealing processing are not performed.

Furthermore, in such a case, the CPU 101 may cause the operation panel 39 to display an error message to give the user an instruction to change the surface/obverse direction of the insert sheet P3.

With these operations, in the case where the image located at the top on the content sheet P1 is located on the inner surface 131*b*, 133*b* of the upper-portion sheet 131 or the lower-portion sheet 133 as in the process C and the process F, an error message is caused to be displayed, and control is performed so that printing processing and enclosing and sealing processing are not performed. Thus, it is possible to always generate a sealed letter in which the image located at the top on the content sheet P1 is located on the outer side, which makes it possible for a user to further easily read the content at the time of unsealing.

The present invention is not limited to the embodiment described above, and it may be possible to carry out the present invention by variously modifying the constituting elements without departing from the main point of the present invention. Furthermore, various inventions may be formed by combining plural constituting elements disclosed in the embodiment described above as appropriate. For example, it may be possible to delete certain constituting elements from all the constituting elements described in the embodiment.

The present application claims priority based on Japanese Patent Application No. 2014-175879 filed on Aug. 29, 2014, the contents of which are incorporated herein by reference in their entirety.

INDUSTRIAL APPLICABILITY

According to the sealed-letter preparing device of the present invention, in the case where the printed sheet (first content) folded in the paper folding unit and the printed sheet (second content) supplied from the inserter unit are overlapped, and are enclosed in the envelope, it is possible to arrange images on each of the enclosed contents so as to have the same top/bottom direction and the same surface/obverse direction. As a result, according to this sealed-letter preparing device, images of the first content and the second content are arranged so as to have the same top/bottom direction and the same surface/obverse direction when a recipient of this sealed letter unseals the letter, pulls out the content from the envelope and unfolds it, whereby it is possible for the recipient to easily read the content.

What is claimed is:

1. A sealed-letter preparing device that encloses a first content and a second content into an envelope sheet transferred on an envelope sheet transfer path, the sealed-letter preparing device comprising:

a paper folder that folds the first content, and sends the first content on a first content transfer path toward the envelope sheet transfer path;

an inserter that sends the second content on a second content transfer path toward the envelope sheet transfer path;

an acquiring processor that acquires information on a top/bottom direction and a surface/obverse direction of the first content and the second content;

a paper-folding controller that changes a way of folding performed by the paper folder according to the information acquired by the acquiring processor;

a merging path section in which the first content transfer path and the second content transfer path merge and the first content folded by the paper folder is overlapped with the second content sent by the inserter; and enclosing section where the envelope sheet transfer path merges with the merged first content transfer path and the second content transfer path such that the first content and the second content, which merge in the merging path section, are enclosed into the envelope sheet sent from the envelope sheet transfer path, wherein the paper-folding controller controls the paper folder so that the top/bottom direction and the surface/obverse direction of an image of the first content match the top/bottom direction and the surface/obverse direction of an image of the second content, based on the information acquired by the acquiring processor such that the first content and the second content are overlapped in the merging path section with a same orientation.

2. The sealed-letter preparing device according to claim 1, further comprising:

a path switching flapper provided on the first content sheet transfer path that switches a transfer path destination of the first content to the merging path section so as to adjust a vertical positional relationship of the first content sent by the paper folder relative to the second content sent by the inserter so that the first content and the second content merge and are overlapped in the merging path section.

* * * * *